US009376759B2

(12) United States Patent
Friedrich et al.

(10) Patent No.: US 9,376,759 B2
(45) Date of Patent: Jun. 28, 2016

(54) COMPOSITIONS, METHODS AND DEVICES FOR GENERATING NANOTUBES ON A SURFACE

(71) Applicant: MICHIGAN TECHNOLOGICAL UNIVERSITY, Houghton, MI (US)

(72) Inventors: Craig Richard Friedrich, Houghton, MI (US); Tolou Shokuhfar, Houghton, MI (US)

(73) Assignee: Michigan Technological University, Houghton, MI (US)

( * ) Notice: Subject to any disclaimer, the term of this patent is extended or adjusted under 35 U.S.C. 154(b) by 200 days.

(21) Appl. No.: 13/798,287

(22) Filed: Mar. 13, 2013

(65) Prior Publication Data

US 2013/0196128 A1 Aug. 1, 2013

Related U.S. Application Data

(63) Continuation-in-part of application No. PCT/US2011/051578, filed on Sep. 14, 2011, and a continuation-in-part of application No. PCT/US2012/055163, filed on Sep. 14, 2012.

(60) Provisional application No. 61/382,761, filed on Sep. 14, 2010, provisional application No. 61/534,739, filed on Sep. 14, 2011.

(51) Int. Cl.
*C25D 7/00* (2006.01)
*C25D 11/02* (2006.01)
(Continued)

(52) U.S. Cl.
CPC ..... *C25D 11/022* (2013.01); *C25D 7/00* (2013.01); *C25D 11/005* (2013.01); *C25D 11/26* (2013.01); *Y10T 428/24917* (2015.01)

(58) Field of Classification Search
None
See application file for complete search history.

(56) References Cited

U.S. PATENT DOCUMENTS

| | | | | |
|---|---|---|---|---|
| 2004/0176828 | A1 | 9/2004 | O'Brien | |
| 2009/0014322 | A1* | 1/2009 | Ramarajan et al. | 204/286.1 |
| 2009/0093881 | A1* | 4/2009 | Bandyopadhyay | A61L 27/306 623/16.11 |

(Continued)

FOREIGN PATENT DOCUMENTS

| | | |
|---|---|---|
| WO | 2004/085098 | 10/2004 |
| WO | 2011/116085 | 1/2011 |
| WO | 2013/040208 | 3/2013 |

OTHER PUBLICATIONS

Panaitescu, Eugen, "Titanium oxide nanotubes: synthesis, properties and applications for solar energy harvesting" (2009). Physics Dissertations. Paper 13, pp. 1-136.*

(Continued)

*Primary Examiner* — Carlos Azpuru
*Assistant Examiner* — Casey Hagopian
(74) *Attorney, Agent, or Firm* — Michael Best & Friedrich LLP

(57) ABSTRACT

A method for modifying a surface by generating nanotubes at one or more selected sites on the surface, the surface including a first metal. The method includes the steps of positioning at least one cathode and at least one anode relative to the surface in an electrolyte solution including a fluoride salt of a second metal, and applying a voltage between the at least one anode and the at least one cathode sufficient to generate nanotubes at one or more selected sites on the surface and to inhibit nanotube formation at one or more of the other selected sites, wherein the nanotubes include the first metal and the second metal.

22 Claims, 32 Drawing Sheets

(51) Int. Cl.
*C25D 11/00* (2006.01)
*C25D 11/26* (2006.01)

(56) References Cited

U.S. PATENT DOCUMENTS

| | | | | |
|---|---|---|---|---|
| 2009/0168139 | A1* | 7/2009 | Hayashi et al. | 359/269 |
| 2010/0024879 | A1 | 2/2010 | Richter et al. | |
| 2010/0187172 | A1 | 7/2010 | Paulose et al. | |
| 2011/0089041 | A1 | 4/2011 | Gupta et al. | |
| 2011/0116085 | A1 | 5/2011 | Lim et al. | |
| 2011/0125263 | A1 | 5/2011 | Webster et al. | |
| 2011/0143127 | A1 | 6/2011 | Gupta et al. | |

OTHER PUBLICATIONS

Dunn et al. "Corrosion of Silver-Plated Copper Conductors", ESA Journal, 1984, vol. 8, pp. 307-335.*

Grimes et al. "Fabrication of TiO2 Nanotube Arrays by Electrochemical Anodization: Four Synthesis Generations", 2009, pp. 1-66.*

PCT/US2011/051578 International Preliminary Report on Patentability and Written Opinion dated Mar. 28, 2013 (8 pages).

Watcharenwong, A. et al., "Self-organized TiO2 nanotube arrays by anodization of Ti substrate: Effect of anodization time, voltage and medium composition on oxide morphology and photoelectrochemical response" J. Mater. Res. 2007, vol. 22, No. 11, pp. 3136-3195.

Zhang, H. et al., "Fabrication of Highly Ordered TiO2 Nanorod/Nanotube Adjacent Arrays for Photoelectrochemical Applications" Langmuir 2010, vol. 26, No. 13, pp. 11226-11232, Apr. 12, 2010.

PCT/US2011/055163 International Search Report dated Nov. 9, 2012 (2 pages).

Dunn et al. "Corrosion of Silver-Plated Copper Conductors", ESA Journal, 1984 (Retrieved on Oct. 21, 2012), vol. 8, pp. 307-335, <URL: http://nepp.nasa.gov>.

Das et al., "Estimation of Shelf Life of Natural Rubber Latex Exam-Gloves Based on Creep Behavior" J Biomedical Materials Research Part B: Applied Biomaterials 87B, May 2, 2008, pp. 398-408.

Inoue et al, "Antibacterial properties of nanostructured silver titanate thin films formed on a titanium plate" J Biomedical Materials Research Part A, 92A, Mar. 3, 2010, pp. 1171-1180.

Thiel et al., "Antibacterial Properties of Silver-Doped Titania" Small 3, 5, 2007, pp. 799-803.

Tao et al., "Fabrication of titania nanotube arrays on curved surface" Elsevier, Electrochemistry Communications 10 (2008) 1161-1163.

Written Opinion for Application No. PCT/US2012/055163 dated Nov. 9, 2012 (5 pages).

* cited by examiner

COMPOSITIONS, METHODS AND DEVICES FOR GENERATING NANOTUBES ON A SURFACE

CROSS-REFERENCE TO RELATED APPLICATIONS

This application is a continuation-in-part of PCT/US2011/051578, filed Sep. 14, 2011, which claims the benefit of U.S. Provisional Application 61/382,761, filed Sep. 14, 2010, and is a continuation-in-part of PCT/US2012/055163, filed Sep. 14, 2012, which claims the benefit of U.S. Provisional Application No. 61/534,739, filed Sep. 14, 2011; each of the above-mentioned applications is incorporated by reference herein in its entirety.

FIELD OF THE INVENTION

The present invention relates to methods and apparatus for generating nanotubes on a surface.

BACKGROUND OF THE INVENTION

Due to their biocompatibility, titanium and titanium alloys are used in a variety of biomedical devices, including orthopedic and dental implants. Titanium and titanium alloys are ideally suited to such applications because they are not only corrosion resistant, but also have the ability to be integrated into bone. Titanium can be subjected to surface modification to alter its biocompatibility, for example by electrochemical etching. Electrochemical etching generates nanotubes of titanium oxide. Electrochemical etching and other modifications can be used to modulate the hydrophobicity/hydrophilicity of the surface. Enhancing hydrophobicity results in a surface that is not easily wettable and sheds water. Enhancing hydrophilicity results in a surface that is wettable and supports cell growth. For example, titania nanotubes can be produced by etching titanium foil in an aqueous electrolyte containing fluoride ions. Conventional methods use a two-electrode DC anodization process that is carried out in a vessel containing an aqueous electrolyte containing fluoride ions, such as hydrofluoric acid, with the titanium foil acting as the working anode, and a platinum mesh acting as the cathode. Conventional methods have proved unsatisfactory because they typically require the use of expensive metals, such as platinum, and/or hazardous chemicals, such as hydrofluoric acid, as a fluoride ion source. Moreover, their commercial applicability is limited because they are most suitable for the uniform modification of small flat titanium foils. Improved methods for modifying surfaces having complex geometries are urgently required for use in orthopedic and dental applications. Advantageously, such methods would provide for the selective modification of portions of the surface using non-hazardous electrolytes and inexpensive electrodes.

SUMMARY OF THE INVENTION

As described below, the present invention features compositions, devices, and methods for generating nanotubes on a surface (e.g., a titanium or titanium alloy surface) and for incorporating an antimicrobial agent into the nanotubes in a controlled manner.

The invention provides for the modification of a surface to generate nanotubes at selected sites on the surface using one or more point or cylindrical graphite electrodes. In one embodiment, the methods of the invention feature the use of non-hazardous electrolytes. Compositions and articles defined by the invention were isolated or otherwise manufactured in connection with the examples provided below. Other features and advantages of the invention will be apparent from the detailed description, and from the claims.

In one embodiment the invention provides a method for modifying a surface by generating nanotubes at one or more selected sites on the surface, the surface including a first metal. The method includes the steps of positioning at least one cathode and at least one anode relative to the surface in an electrolyte solution including a fluoride salt of a second metal; and applying a voltage between the at least one anode and the at least one cathode sufficient to generate nanotubes at one or more selected sites on the surface and to inhibit nanotube formation at one or more of the other selected sites, wherein the nanotubes include the first metal and the second metal.

The invention also provides a titanium or titanium alloy surface modified according to the disclosed methods, and a biomedical implant or device having a surface, at least a portion of which is modified according to the disclosed methods.

The invention further provides a method for modifying a surface by generating nanotubes at one or more selected sites on the surface, the surface including titanium. The method includes the steps of positioning at least one cathode and at least one anode relative to the surface in an electrolyte solution including silver; and applying a voltage between the at least one anode and the at least one cathode sufficient to generate nanotubes at one or more selected sites on the surface and to inhibit nanotube formation at one or more of the other selected sites, wherein the nanotubes include titanium and silver.

In one aspect, the invention provides a method for modifying a metal surface to generate nanotubes at one or more selected sites on the surface, the method involving positioning at least one cathode and one or more anodes relative to a metal surface in an electrolyte solution, where the anodes are in proximity to the metal surface; and applying a voltage between the one or more anodes and the cathodes sufficient to generate nanotubes at one or more selected sites and to inhibit nanotube formation at other selected sites.

In another aspect, the invention provides a method for modifying a metal surface at one or more selected sites on the surface, the method involving positioning one or more anodes in proximity to a metal surface in an electrolyte solution; and applying a voltage between the one or more anodes and one or more cathodes sufficient to modify the metal surface at one or more selected sites and to inhibit modification at other selected sites.

In an additional aspect, the invention provides a method for modifying a metal surface to generate nanotubes at one or more selected sites on the surface, the method involving positioning at least one cathode and an anode array having a plurality of anodes in an electrolyte solution, where the anodes are in proximity to the metal surface; and applying a voltage between the cathode and the anode array sufficient to generate nanotubes at one or more selected sites and to inhibit nanotube formation at other selected sites.

In still another aspect, the invention provides a device for modifying a titanium or titanium alloy surface to form nanotubes at one or more selected sites on the surface, having at least one cathode, one or more anodes and a titanium or titanium alloy surface in an electrolyte solution, where the one or more anodes is in proximity to the surface; at least one power supply in electrical communication with the cathode (s) and anode(s), where nanotubes are formed on the surface when voltage is applied in the presence of an electrolyte solution; and a support for positioning the cathode and one or more anodes relative to the surface. In various embodiments, the device has two or more point or cylindrical cathodes or anodes positioned relative to selected sites on the surface.

In various embodiments of any of the aspects delineated herein, the modification of the metal surface involves nanotubes or the generation of nanotubes. In various embodiments of any of the aspects delineated herein, the surface is polished and/or sequentially sonicated prior to anodization. In various embodiments of any of the aspects delineated herein, the surface is titanium or a titanium alloy. In various embodiments, the nanotubes are T1O2 nanotubes. In particular embodiments, the T1O2 nanotubes have no detectable traces of other elements. In various embodiments of any of the aspects delineated herein, the nanotubes formed at one selected site are the same or different in length and diameter from nanotubes formed at another site on the surface. In various embodiments of any of the aspects delineated herein, the surface is present on a biomedical implant or medical device. In particular embodiments, the implant is a dental implant, cardiovascular implant, neurological implant, neurovascular implant, gastrointestinal implant, muscular implant, orthopedic implant, cochlear implant, and/or ocular implant. In specific embodiments, the orthopedic implant is a joint implant, spinal implant, screw, pin, rod, and/or plate. In various embodiments of any of the aspects delineated herein, the method involves loading the nanotubes with an effective amount of a biologically active agent. In various embodiments of any of the aspects delineated herein, the nanotubes contain or have an effective amount of an agent. In various embodiments, the agent is an antimicrobial, anti-inflammatory, growth factor, or statin.

In various embodiments of any of the aspects delineated herein, the electrolyte solution contains NH4F. In various embodiments the electrolyte solution contains ethylene glycol or propylene glycol. In various embodiments of any of the aspects delineated herein, the anodes and cathode are graphite. In various embodiments of any of the aspects delineated herein, the cathode or anodes are point or cylindrical electrodes. In various embodiments of any of the aspects delineated herein, the applied voltage is +60 VDC. In various embodiments of any of the aspects delineated herein, the anode is positioned between 0.01-10 mm from the surface. In various embodiments of any of the aspects delineated herein, the cathode is positioned between 1-100 mm from the surface. In various embodiments of any of the aspects delineated herein, the voltage, time for which the voltage is applied, and distance between the anodes and the surface is varied.

In various embodiments of any of the aspects delineated herein, surface modification is inhibited on a portion of the metal surface in proximity to at least one of the anodes or array of anodes. In various embodiments of any of the aspects delineated herein, nanotube growth is reduced or absent at one or more selected sites on the surface. In various embodiments of any of the aspects delineated herein, the distance of the cathode and/or anode relative to the surface, voltage, and time for which the voltage is applied are selected to form nanotubes whose length and/or diameter differs between sites on the surface.

In various embodiments of any of the aspects delineated herein, the surface is thermally treated following modification. In particular embodiments, the thermal treatment is carried out between 300 and 500 [deg.]C. In various embodiments of any of the aspects delineated herein, the method increases the wettability of the surface. In various embodiments of any of the aspects delineated herein, the method enhances the ability of the surface to support cell growth. In various embodiments of any of the aspects delineated herein, the nanotubes contain a cell. In particular embodiments, the cell is an osteoblast, fibroblast, or a progenitor or a descendant of the cell.

DEFINITIONS

By "agent" is meant any small compound, antibody, nucleic acid molecule, or polypeptide, or fragments thereof.

By "antimicrobial" is meant an agent that inhibits or stabilizes the proliferation or survival of a microbe. In one embodiment, a bacteriostatic agent is an antimicrobial. In other embodiments, any agent that kills a microbe (e.g., bacterium, fungus, virus) is an antimicrobial.

By "anti-inflammatory" is meant an agent that reduces the severity or symptoms of an inflammatory reaction in a tissue. An inflammatory reaction within tissue is generally characterized by leukocyte infiltration, edema, redness, pain, and/or neovascularization. Inflammation can also be measured by analyzing levels of cytokines or any other inflammatory marker.

By "biomedical implant" is meant any exogenous material that is introduced in to the body of a subject.

By "descendant" is meant a cell type that arises from the cell division and/or differentiation of a progenitor cell.

By "effective amount" is meant the amount of an agent required to ameliorate the symptoms of a disease relative to an untreated patient. The effective amount of active agent(s) used to practice the present invention for therapeutic treatment of a disease varies depending upon the manner of administration, the age, body weight, and general health of the subject. Ultimately, the attending physician or veterinarian will decide the appropriate amount and dosage regimen. Such amount is referred to as an "effective" amount.

By "elution rate" is meant the time required for an agent to be substantially released from a composition. Elution can be measured by determining how much of an agent remains within the composition or by measuring how much of an agent has been released into the composition's surroundings. Elution may be partial (10%, 25%, 50%, 75%, 80%, 85%, 90%, 95% or more) or complete. In one preferred embodiment, the agent continues to be released at an effective level for at least about 3, 4, 5, 6, 7, 8, 9, or 10 days.

By "infection" is meant the presence of one or more pathogens in a tissue or organ of a host. An infection includes the proliferation of a microbe (e.g., bacteria, viruses, fungi) within a tissue of a subject at a site of trauma.

By "progenitor" is meant a cell that gives rise during division and/or differentiation to another cell type.

By "proximity" is meant a distance sufficient for an anode to inhibit nanotube formation at a desired site. In one embodiment, an anode is in proximity to a site when it is about 1-20 mm from the site.

By "reference" is meant a standard or control condition.

By "selected site" is meant a portion of the surface that is chosen for modification. In contrast, other portions of the surface—sites that are not selected—are not modified.

By "subject" is meant a mammal, including, but not limited to, a human or non-human mammal, such as a bovine, equine, canine, ovine, or feline.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50.

Unless specifically stated or obvious from context, as used herein, the term "or" is understood to be inclusive. Unless specifically stated or obvious from context, as used herein, the terms "a", "an", and "the" are understood to be singular or plural.

Unless specifically stated or obvious from context, as used herein, the term "about" is understood as within a range of normal tolerance in the art, for example within 2 standard deviations of the mean. About can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

Any compositions or methods provided herein can be combined with one or more of any of the other compositions and methods provided herein.

BRIEF DESCRIPTION OF THE DRAWINGS

FIG. 5A shows SEM images of $TiO_2$ nanotubes of varying diameters. FIG. 5B shows a graph of $TiO_2$ nanotube diameter v. time at 20V, 40V, and 60V.

FIG. 7A shows six samples in total that were investigated, including pure titanium and titanium alloys having bare surfaces, not-annealed TNT surfaces, and annealed TNT surfaces. FIG. 7B shows a plot of results of the contact angles on the surfaces. The TNT surfaces were more hydrophilic and the annealing effect made the TNT surface superhydrophilic. Contact angle differences were attributed to the surface properties, in particular the surface roughness, which could affect the initial contact angle of a water droplet on each titanium surface.

FIG. 9A shows water droplet wettability on annealed and as-anodized TNT surfaces. The increasing contact angles varied in each case but all of the TNT samples increased the surface wettability. FIG. 9B shows the cases of bare titanium. In these cases, the wettability had little, if any, change with time.

FIGS. 21D-21F are images showing cell filopodia attachment and spreading on and between nanotubes. The nanotubes can act as anchors for cell filopodia to grab (FIG. 21F) and increase the spreading (FIG. 21D) and improve its attachment (FIG. 21E). Scale bars are 3 μm (FIG. 21D), 500 nm (FIG. 21E), and 1 μm (FIG. 21F). FIG. 21G is an image showing an osteoblast filopodia—its foot used for locomotion—anchored to titanium nanotubes and ECM production on and in between nanotubes during cell migration and bone matrix deposition. Scale is 50 μm.

DETAILED DESCRIPTION OF THE INVENTION

Figure 1:
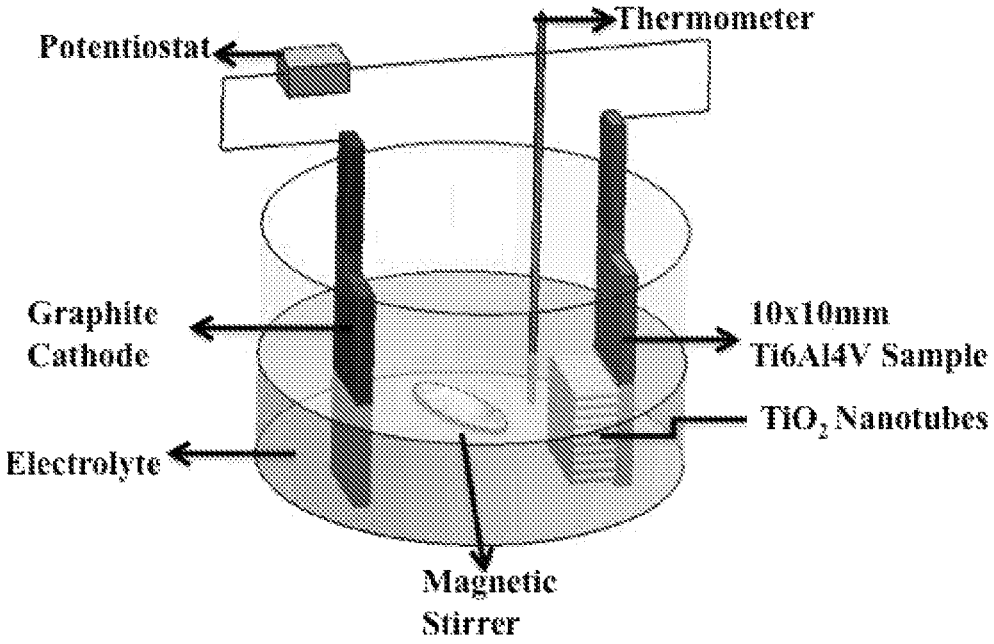
FIG. 1 is a schematic of a nanotube etching system. The cathode electrode shown here is graphite, which was used as a replacement for platinum (which is more cost-prohibitive). The same set up was used during etching experiments using platinum (Pt), copper (Cu), stainless steel, and graphite as counter electrodes.

The present invention generally features compositions and methods for generating nanotubes on a surface (e.g., a titanium or titanium alloy surface) at selected sites and coating the nanotubes with a second metal or incorporating the second metal into the nanotubes, either as a separate step or in conjunction with nanotube formation. In one embodiment, the second metal (e.g., calcium) enhances the surface's ability to support mammalian cell growth. In another embodiment, the second metal (e.g., silver) has anti-microbial activity that reduces the propensity of the surface to support microbial (e.g., bacterial, fungal) growth. In yet another embodiment, a combination of two or more fluoride salts in the electrolyte (such as, but not limited to, silver fluoride and calcium fluoride) will result in the combined properties. In various embodiments, the invention includes methods for adjusting the amount of the second metal that is added to the nanotubes in order to control the properties that the second metal produces.

The invention is based, at least in part, on the following discoveries: first, that nanotubular structures can be fabricated using a benign electrolyte comprising ethylene glycol, water, and ammonium fluoride, silver fluoride and/or calcium fluoride; nanotubular structures are fabricated using inexpensive graphite rod or graphite point electrodes, rather than expensive platinum electrodes; third, graphite point electrodes can be used to selectively fabricate nanotubes at desired sites, while concurrently inhibiting generation of nanotubes at other sites; and finally, that by varying the voltage applied at each of the electrodes and varying the length of time the voltage is applied the surface can be selectively modified at discrete sites with nanotubular structures of selected lengths. Advantageously, these nanotubes can be further modified to comprise a second metal. In particular embodiments, the invention features arrays of electrodes suitable for selectively modifying surfaces having complex geometries, such that the growth of nanotubes is permitted at particular sites and concurrently inhibited at other sites. As reported in more detail below, nanotubular structures are fabricated into Ti6Al4V ELI surgical orthopedic cancellous and cortical bone screws using electrodes of the invention. These nanotubes survive multiple insertion and removal cycles in an accepted bone simulant material. Accordingly, the invention provides benign electrolytes, electrodes (e.g., graphite point and cylindrical electrodes), and automated devices comprising point and/or cylindrical electrodes for fabricating nanotubes on the surface of pure and Ti6Al4V titanium sheets and Ti6Al4V ELI orthopedic hardware by anodization. In certain embodiments, this process advantageously modifies the surface to enhance mammalian cell growth and adhesion and/or to reduce the surface's ability to support microbial cell growth.

Electrolyte

The present invention utilizes electrolytes suitable for use in the electrochemical etching or modification of surfaces (e.g., titanium and titanium alloys) to generate nanotubular structures. The electrolytes used in the invention are advantageously free of hydrofluoric acid and other caustic, hazardous, or otherwise dangerous sources of fluoride ions. Because these electrolytes are benign they are suitable for modification of surfaces to be implanted in a subject to enhance cell growth and cell adhesion. In particular, the invention utilizes aqueous electrolytes comprising ethylene glycol or propylene glycol, water, and a fluoride-containing salt. The fluoride-containing salt is in solution (i.e., in water). The amount of water in the electrolyte is about 0.1%, 0.25%, 0.5%, 1-2%, 5%, or 10% (v/v). The fluoride-containing salt may include one or a combination of fluoride-containing salts (e.g., ammonium fluoride, silver fluoride and/or calcium fluoride). In a particular embodiment, the fluoride-containing salt is ammonium fluoride. The amount of fluorine atom present in the electrolyte can be determined or calculated using methods known in the art. For example, fluorine is about 51% of ammonium fluoride by weight. The electrolyte contains about 5-1000 mg fluorine/100 ml (e.g., 5, 10, 25, 50, 100, 200, 250, 300, 400, 500, 750, 1000 mg fluorine/ml). In a particular embodiment, the electrolyte comprises up to 330 mg fluoride ion/50 ml electrolyte. It has been observed that increasing the amount of fluoride ion in the electrolyte decreases etch times, and weaker electrolyte etches more slowly. Etch times range from 5 minutes-60 minutes (e.g., 5, 10, 15, 20, 25, 30, 35, 40, 45, 50, 55, 60 minutes). In a specific embodiment, 337 mg fluorine/100 ml provides a desirable etch time.

Electrodes and Electrode Geometry

Conventional anodization methods use a two-electrode DC anodization process that is carried out in a vessel containing an aqueous electrolyte containing fluoride ions, such as hydrofluoric acid. In this conventional system, titanium foil acts as the anode and a platinum mesh acts as the cathode. The use of a platinum cathode increases the cost associated with anodization. The invention advantageously provides electrochemical etching methods featuring graphite point and cylindrical electrodes (e.g., cathodes, anodes), which provide a significant cost savings.

The invention further provides for the use of one or more inhibitory electrodes (e.g., anodes) to which voltage (e.g., +60 VDC) is applied. The inhibitory electrode selectively inhibits nanotube fabrication at selected sites on the surface. This is particularly useful for biomedical implants where cell growth can be enhanced at desired portions of the implant surface and inhibited at other sites on the implant surface. In one embodiment, the formation/inhibition of nanotubes and the deposition of a second metal is carried out in a single electrolyte. In another embodiment, the formation/inhibition of nanotubes is carried out in a first electrolyte (e.g., ammonium fluoride) and the deposition of a second metal is carried out in a second electrolyte (e.g., silver fluoride, calcium fluoride).

The invention further features the use of electrode arrays (e.g., two, three, four, five, six, seven, eight, nine, ten, or more electrodes) that are positioned in three-dimensional space relative to the titanium surface to be modified. This provides for the growth of nanotubes on surfaces having complex geometries. In particular embodiments, one or more of the electrodes is positioned in the electrolyte together with the surface to be modified. Between +25 and 100 VDC is applied to one or more of the electrodes. Other electrodes serve as ground electrodes. In one embodiment, 50, 55, 60, 65, or 70, 110, 120, 150, 175, 200 V DC or up to the electrolyte breakdown voltage is applied to one or more electrodes. The area of inhibition of nanotube formation may be controlled by adjusting the number and/or proximity of inhibitory anodes. Large areas of the surface may be inhibited for nanotube formation by using multiple inhibitory electrodes without limitation (e.g., over a square foot). Depending on the size of the electrode, nanotube formation may be inhibited over smaller areas (e.g., using a point electrode). It has been observed that the area of inhibition of nanotube formation is approximately the diameter of point electrode plus 2× the gap distance (e.g., a 1 mm point electrode, 1 mm from surface, yields a zone of inhibition about 3 mm). Areas where inhibition is inhibited can be from less than 1 $mm^2$ to a $meter^2$ or more (e.g., 0.1, 0.5, 1, 2, 3, 4, 5, 10, 25, 50, 100, 125, 150, 175, 200, 300, 400, 500, 600, 700, 800, 900, 1000 mm). Additionally, the closer the anode is to the substrate, the smaller the area of inhibited tube growth. The ability to modify the formation of nanotubes is advantageous for modulating cellular interactions with the surface, e.g., to promote preferential cell growth, encourage osteoblast growth and/or migration, to prevent fibroblast growth and/or migration, or to prevent angiogenesis in a stent.

If desired, an inhibitory electrode may be fabricated of carbon nanotubes and used to inhibit nanotube formation on a surface. Such inhibitory electrodes may be 0.5, 1 mm, 2 mm, or 3 mm in diameter. In general, a point electrode or cylindrical electrode(s) is positioned at a distance that is between about 0.1, 0.05, 1 mm to about 100 mm or more (e.g., 1, 3, 5, 6, 7, 8, 9, 10, 15, 20, 25, 30, 35, 40, 45, 50, 55, 60, 65, 70, 75, 80, 85, 90, 95, 100 mm) from the substrate. There should be no limit to this separation distance. The smallest distance for position depends on the electrical strength of the electrolyte, the voltage between the anode and metal substrate, and the thickness of electrolyte. The gap should be small enough so as not to exceed the breakdown voltage between electrode and titanium (i.e., does not arc). Nanotubes are quickly fabricated with a voltage up to +60 VDC, although other voltages can be used to fabricate nanotubes having the desired properties. Such voltage are selected to optimize nanotube length to support cell growth and to optimize for mechanical stability. The electrodes in an array may have the same voltages applied or may have different voltages. They may be at the same distance from the surface or at different distances.

Figure 10:
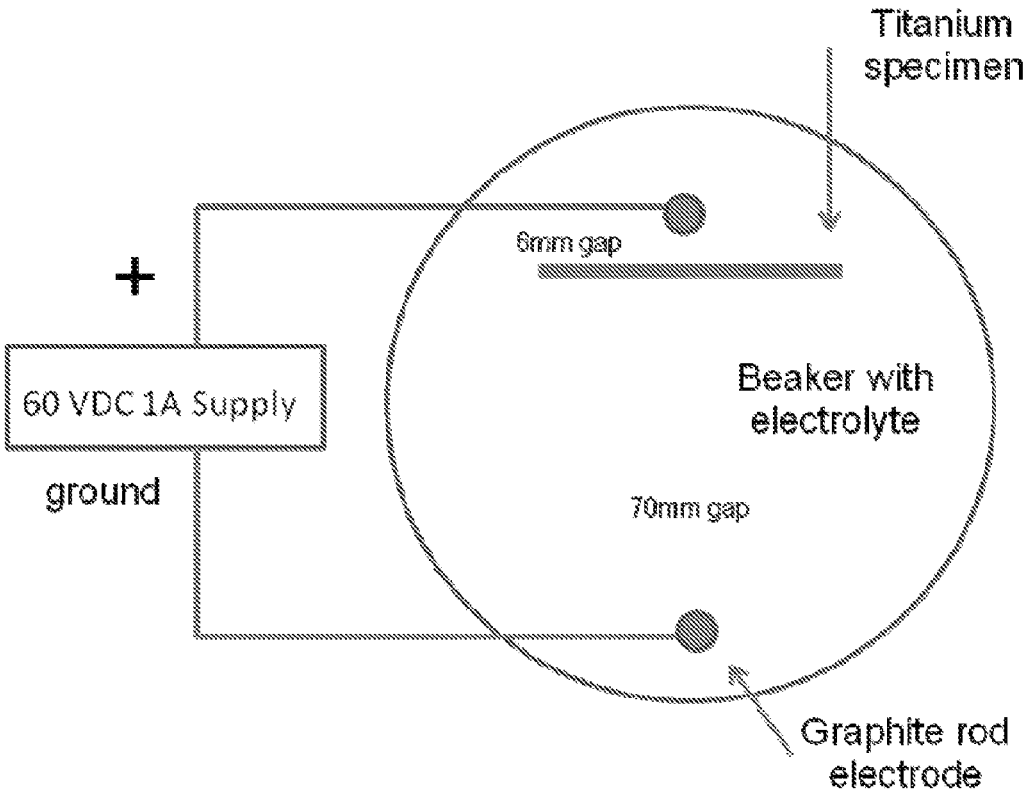
FIG. 10 is a top view schematic of a basic single graphite cylinder electrode system to inhibit nanotube growth near the +60 VDC electrode (marked +), where the titanium substrate is placed between the electrodes.
Figure 11:
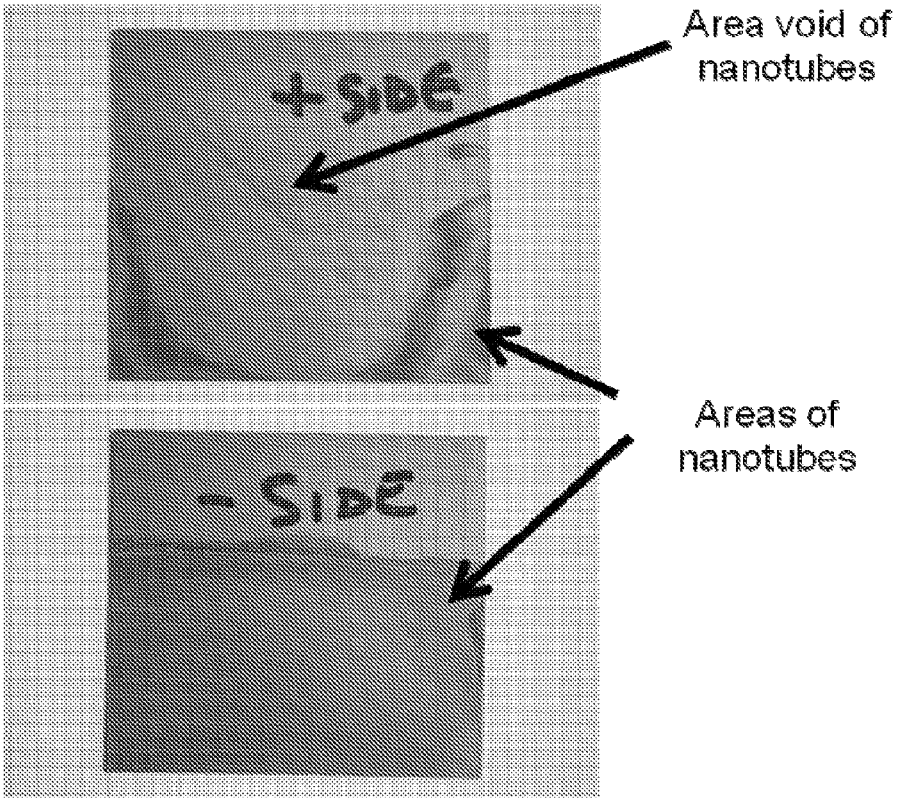
FIG. 11 depicts images of the two sides of a titanium specimen etched using a single graphite cylinder electrode to inhibit nanotube growth near the +60 VDC electrode as shown in FIG. 10.
Figure 12:
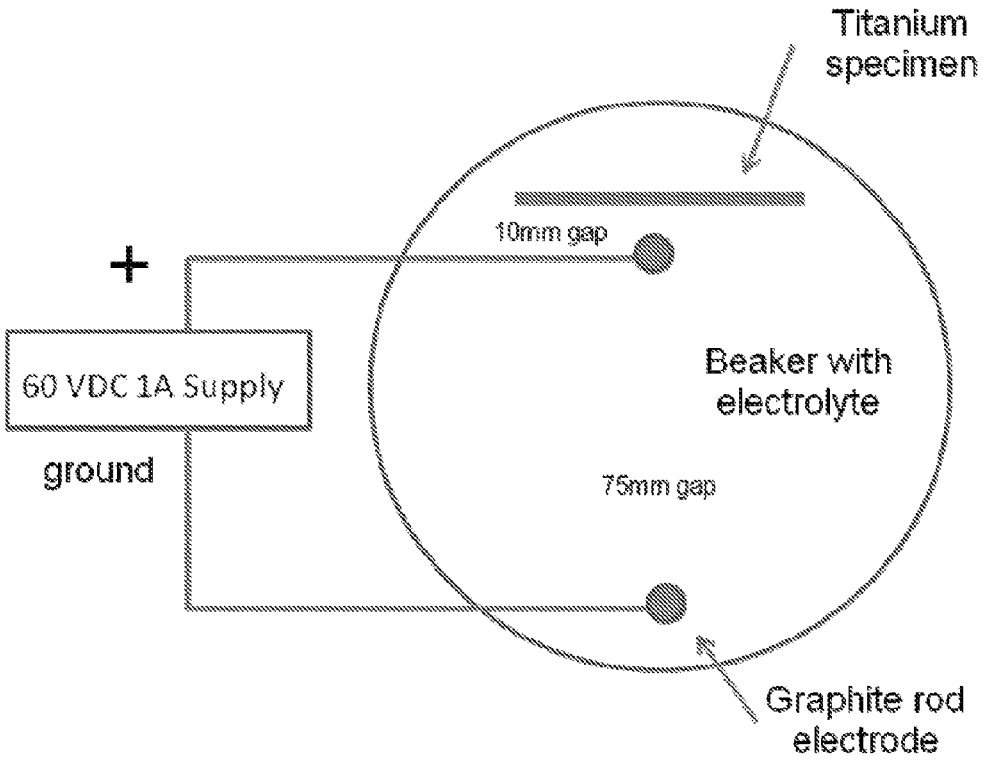
FIG. 12 is a top view schematic of a single graphite cylinder electrode system to inhibit nanotube growth near the +60 VDC electrode (marked +), where the +60 VDC electrode is placed between the titanium and the graphite rod electrode.
Figure 14:
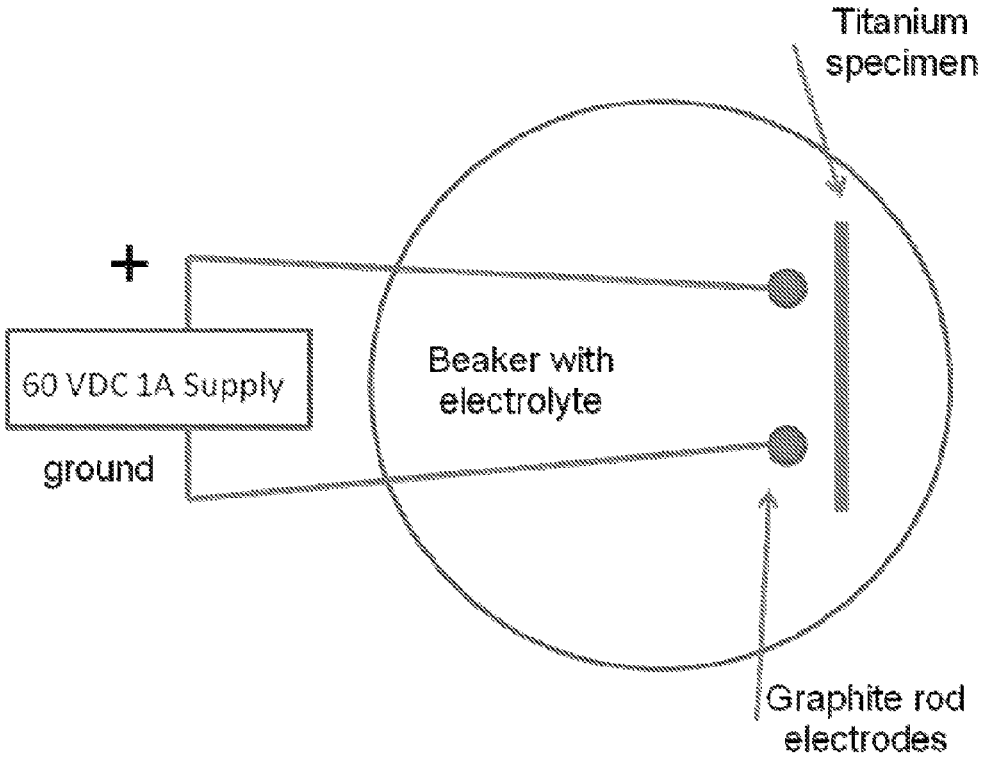
FIG. 14 is a top view schematic of a system to inhibit nanotube growth in one-half of a titanium specimen in which nanotube growth is inhibited using a graphite cylindrical rod electrode (marked +), where the electrodes are placed in close proximity to each other and the titanium substrate.

In particular embodiments, nanotubes are preferentially formed or inhibited by the positioning of one or more point or cylindrical electrodes. For example, as shown in FIG. 11, nanotube growth is inhibited in a substrate in proximity to the +60 VDC electrode ("the inhibitory electrode or anode"). The distance between the inhibitory electrode and the substrate is between about 3-10 mm (e.g., about 3, 4, 5, 6, 7, 8, 9, 10 mm) A smaller separation distance provides a more localized inhibition of nanotube etching. The separation distance can be as small as desired, providing there is sufficient electrolyte between the electrode(s) and the specimen surface. Nanotube growth occurs on other portions of the surface that are not in proximity to the inhibitory electrode. The distance between the cylindrical graphite ground electrode and the substrate is between about 50-100 mm (e.g., 50, 60, 70, 80, 90, 100). The substrate whose surface is to be modified can be between the inhibitory electrode and the ground electrode (as shown in FIG. 10), or the inhibitory electrode and the ground electrode can be on the same side of the surface to be modified (as shown in FIGS. 12 and 14).

Point and cylindrical electrodes can be made of virtually any conducting material (e.g., platinum, stainless steel, copper and graphite). Preferably, the electrode is any electrically conducting material that does not adversely contaminate the surface. Small nanotubes may also be generated using nanoscale electrodes including carbon nanotubes and titanium nanotubes. In one embodiment, an electrode array comprises a combination of graphite point electrodes to which current is applied and a single ground electrode. In another embodiment, an electrode array comprises one or a combination of graphite point electrodes to which current is applied and ground electrodes, which are also graphite point electrodes. In some embodiments, electrochemical etching may be monitored by color formation, (e.g., when a copper anode is used). Additionally, electrochemical etching may be monitored optically (e.g., opaqueness of the electrolyte, UV absorption), by measuring the formation of titanium in solution, or by detecting changes in conductivity.

By selecting the voltage of each electrode and/or the titanium, nanotube fabrication can be allowed in selected regions of the titanium and inhibited in other selected regions of the titanium. If the time that the voltage is applied is also varied at each of the multiple electrodes in an array nanotubular structures of varying lengths can be fabricated at desired sites on the substrate.

Cylindrical electrodes are typically uncoated strands of conductive material. Rod electrodes may be composed of copper, graphite, or other suitable electrically conductive material. Point electrodes are formed when a strand of copper, graphite, or other suitable electrically conductive material is coated with an insulating layer to produce a single electrical near-point source. Insulating layers include, but are not limited to, plastic heat-shrink tubing, paints, lacquers, epoxies or other electrically insulating materials compatible with the electrolyte and the process. By using point and cylindrical electrodes at the proper locations, distances, voltages, and times, tubular nanostructures can also be etched on the surface of interior features, such as holes and sharp depressions of regular and irregular shape, interior sharp corners and concave features, exterior features such as protrusions of regular and irregular shape, exterior sharp corners and convex features. Such complex geometries are typically found on the surface of orthopedic implants or other implantable devices where such tubular nanostructures are desired.

Nanotube Parameters

In general, the length of a nanotube is a function of the conditions under which the nanotube was formed. Nanotubular structures are fabricated on the specimen when the voltage potential of the specimen is higher than surrounding electrodes. This is defined as "current leaving" the specimen—that is charge is moving from a more positive voltage to a lower voltage at any location on the titanium specimen. If however, "current enters" the titanium specimen at any location, nanotube fabrication is inhibited. Under these specified fabrication conditions, the specimen may or may not be electrically connected to the electrochemical etching circuitry. The specimen may be allowed to electrically "float" without imposing a particular voltage.

The point electrodes and cylindrical electrodes of the invention, alone or in arrays, provide for the fabrication of arrays of nanotubes. By altering the position of the multiple electrodes relative to the surface, the distances of each of the electrodes from the surface, the voltage applied to each of the multiple electrodes, and the length of time of etching, the properties of the nanotubes can be predictably altered (i.e., the length, diameter, pore size).

For example, nanotubes are fabricated to have a wall thickness ranging from about 3 nm to about 300 nm (e.g., 3, 5, 10, 15, 20, 25, 50, 75, 100, 125, 150, 175, 200, 225, 250, 300 nm), preferably 5-10 nm. Nanotubes are fabricated to have an inner diameter ranging from about 3 nm to about 300 nm (e.g., 3, 5, 10, 15, 20, 25, 50, 75, 100, 125, 150, 175, 200, 225, 250, 300 nm), preferably 30-80 nm. Nanotubes are fabricated to have an outer diameter ranging from about 3 nm to about 300 nm (e.g., 3, 5, 10, 15, 20, 25, 50, 75, 100, 125, 150, 175, 200, 225, 250, 300 nm), preferably 80-120 nm. In some embodiments, the nanotubes are fabricated at a density of at least about 100,000,000, 200,000,000, or 300,000,000 nanotubes per square centimeter. Exemplary morphologies of titanium nanotubes and titanium nanotube surfaces include honey comb (see, e.g., FIG. 2A) and free-standing nanotubes (see e.g., FIG. 5A). In other embodiments, the nanotubes are fabricated at a density of at least about 25,000,000, 50,000,000, or 75,000,000 nanotubes per square centimeter (e.g., free-standing nanotubes). The nanotube density may range from many millions per square centimeter to several billion per square centimeter for the closely packed honeycomb configuration. Nanotubes are fabricated to have a length ranging from about 1 μm to about 100 μm (e.g., 1, 3, 5, 10, 20, 25, 50, 75, 100). Nanotubes longer than 10 μm are structurally weak and separate from the metal substrate. Nanotubes are fabricated to have pores that range in diameter from about 3 nm to about 250 nm (e.g., 3, 5, 10, 15, 20, 25, 50, 75, 100, 125, 150, 175, 200, 225, 250 nm), preferably 10 nm to 100 nm. Advantageously, the electrode arrays of the invention allow the surface to be heterologously modified. For example, longer nanotubes can be fabricated at selected sites on the surface, while shorter nanotubes are formed at other selected sites, and nanotube formation is inhibited at still other sites.

In other embodiments, the polarity of the anode and cathode are reversed such that nanotubes are fabricated over sites on the surface where nanotube growth was previously inhibited. This provides one or more regions of relatively long nanotubes and one or more regions of shorter nanotubes, based on the total time and current flow direction of each region.

In still other embodiments, the polarity of the anode and cathode are reversed such that a second metal (e.g., silver, calcium) is deposited on the surface. The length of time that the voltage is applied determines the amount of metal deposited. In one embodiment, the voltage is applied for between about 5-60 (e.g., 5, 10, 15, 20, 25, 30, 35, 40, 45, 50, 55, 60) minutes.

Pre-Electrochemical Etching Treatments

Prior to carrying electrochemical etching, the substrate can be prepared in any of a variety of ways. The surface may be modified to be smooth or made abrasive. For example, the surface may be wiped with solvent (e.g., acetone), polished (e.g., using colloidal $SiO_2$), sonicated (e.g., sequentially sonicated in acetone, isopropyl alcohol, and methanol). If desired, after the pre-treatment the surface is rinsed with deionized water, and dried (e.g., dried under $N_2$). Pre-treatment may at least depend in part on the characteristics of the base metal (e.g., having fine grains or large grains). Alloys are work hardened and have high density dislocation networks, thus, abrading the surface exposes grains. To remove exposed grains, metal alloys may be heat treated, rinsed with acetone, washed to remove the acetone, machined, and polished.

Post-Electrochemical Etching Treatments

Following electrochemical etching and deposition of a second metal, the substrate comprising titanium oxide ($TiO_2$) nanotubes can be treated to further modify the surface properties. $TiO_2$ occurs in different crystalline structures. In one embodiment, the surface is heated between about 400 and 500° C. (e.g., 400, 425, 450, 500° C.). Temperatures greater than 500° C. may also be used. The surface may be heated for one, two, three, four, or five hours. In one embodiment, the surface is heated using a rapid thermal annealer. A heating/cooling rate of 308° C./min was used, and the substrates were annealed in air at 450° C. for 3 hours. This annealing treatment results in phase transformation of $TiO_2$ nanotubes from amorphous to crystalline anatase. Anatase is one of the three mineral forms of titanium dioxide, the other two being brookite and rutile. Brookite is orthorhombic, and rutile is the most common polymorph. This post-treatment modifies the wettability of the surface, alters the surface charge, and may alter the structural strength, stiffness, and toughness. For example, heat treatment in $N_2$ and/or $CO_2$ may be used to harden Ti nanotubes or impart other properties.

The invention provides compositions and methods for fabricating nanotubes on the surface of a substrate, such as pure and Ti6Al4V titanium sheets and Ti6Al4V ELI orthopedic hardware by electrochemical etching. In certain embodiments, the nanotubes enhance cell growth and adhesion to the surface. In one embodiment, such surface modifications affect surface wettability and surface potential. Increased wettability of a surface means that water will spread out more on such a surface. Wettability also is directly related to the surface hydrophilicity (i.e., increased hydrophilicity means greater wettability) and increased surface energy. Methods for measuring wettability are known in the art and described in the Examples. In one embodiment, wettability is assayed by obtaining contact angles, contact radii, and center-heights of water droplets on a nanotube surface. Preferably, the contact angle is reduced following electrochemical etching and/or other post-electrochemical etching treatment relative to the contact angle of untreated titanium. In one embodiment, contact angles are decreased by 50-75% compared to the contact angles of each bare foil.

Medical Implants and Devices

Surfaces such as titanium or titanium alloy surfaces can be modified using the methods described herein to include $TiO_2$ nanotubes comprising a second metal that is deposited onto the surface. In certain embodiments, nanotubes are formed on titanium and/or titanium alloy implants or devices. In one embodiment, the invention provides for the modification of the surface of a titanium port (or portacath) for the delivery of therapeutics to a subject. Exemplary implants include dental implants, cardiovascular implants such as a pacemaker, neurological implants, neurovascular implants, gastrointestinal implants, muscular implants, cochlear implants, orthopedic implants, and ocular implants where bony fixation or cellular attachment is desirably enhanced. Other implants and devices include orthopedic devices (e.g., for joint implants, fracture repairs, spinal implants, screws, rods, plates); surgical devices (e.g., sutures, staples, anastomosis devices, vertebral disks, bone pins, suture anchors, hemostatic barriers, clamps, screws, plates, clips, vascular implants, tissue adhesives and sealants, tissue scaffolds); wound management devices; drug-delivering vascular stents (e.g., a balloon-expanded stents); other vascular devices (e.g., grafts, catheters, valves, artificial hearts, heart assist devices); implantable defibrillators; blood oxygenator devices (e.g., tubing, membranes); membranes; biosensors; shunts for hydrocephalus; endoscopic devices; infection control devices; dental devices (e.g., dental implants, fracture repair devices), urological devices (e.g., penile, sphincter, urethral, bladder and renal devices, and catheters); ophthalmic devices (e.g. intraocular coils/screws); glaucoma drain shunts; synthetic prostheses (e.g., breast); intraocular lenses; respiratory, peripheral cardiovascular, spinal, neurological, dental, ear/nose/throat (e.g., ear drainage tubes); renal devices; and dialysis (e.g., tubing, membranes, grafts), urinary catheters, intravenous catheters, small diameter grafts, vascular grafts, artificial lung catheters, atrial septal defect closures, electro-stimulation leads for cardiac rhythm management (e.g., pacer leads), glucose sensors (long-term and short-term), degradable coronary stents (e.g., degradable, non-degradable, peripheral), blood pressure and stent graft catheters, birth control devices, prostate cancer implants, bone repair/augmentation devices, breast implants, cartilage repair devices, dental implants, implanted drug infusion tubes, intravitreal drug delivery devices, nerve regeneration conduits, oncological implants, electrostimulation leads, pain management implants, spinal/orthopedic repair devices, wound dressings, embolic protection filters, abdominal aortic aneurysm grafts, heart valves (e.g., mechanical, polymeric, tissue, percutaneous, carbon, sewing cuff), valve annuloplasty devices, mitral valve repair devices, vascular intervention devices, left ventricle assist devices, neuro-aneurysm treatment coils, neurological catheters, left atrial appendage filters, hemodialysis devices, catheter cuff, anastomotic closures, vascular access catheters, cardiac sensors, uterine bleeding patches, urological catheters/stents/implants, aneurysm exclusion devices, and neuropatches.

Examples of other suitable devices include, but are not limited to, vena cava filters, urinary dialators, endoscopic surgical tissue extractors, atherectomy catheters, clot extraction catheters, coronary guidewires, drug infusion catheters, esophageal stents, circulatory support systems, angiographic catheters, coronary and peripheral guidewires, hemodialysis catheters, neurovascular balloon catheters, tympanostomy vent tubes, cerebro-spinal fluid shunts, defibrillator leads, percutaneous closure devices, drainage tubes, thoracic cavity suction drainage catheters, electrophysiology catheters, stroke therapy catheters, abscess drainage catheters, biliary drainage products, dialysis catheters, central venous access catheters, and parental feeding catheters.

Also provided are methods of treating a patient in need of a medical implant. The methods involve selecting a medical implant where the implant comprises a surface having nanotubes capable of enhancing or promoting cell growth or proliferation and placing the implant into the patient. In this embodiment, the term "selecting" means, for example, purchasing, choosing, or providing the implant rather than preparing the implant.

By varying the time of electrochemical etching of the native material surface, the implant surface can be engineered to provide the desired local nanostructured surface. By using point and cylindrical electrodes at the proper locations, distances, voltages, and times, tubular nanostructures can also be etched on the surface of interior features such as holes and sharp depressions of regular and irregular shape, interior sharp corners and concave features, exterior features such as protrusions of regular and irregular shape, exterior sharp corners and convex features, all typically found on the surface of orthopedic implants or other implantable devices where such tubular nanostructures are desired.

Advantageously, second metals or combinations of metals are used to coat the surface or are otherwise incorporated into the surface to alter its ability to support mammalian cell or microbial cell growth.

Nanotubes for Drug Delivery

In another embodiment of the invention, an implant that has undergone electrochemical etching is used to deliver therapeutic or prophylactic agents in vivo. More specifically, the titanium nanotubes on the implant surface act as carriers and reservoirs to deliver drugs to certain locations of the body over various predetermined time periods.

The invention provides a simple means for delivering biologically active agents (e.g., small compounds, nucleic acid molecules, polypeptides) using a nanotube modified implant or medical device. The nanotube modified implant is delivered to a subject and the biologically active agent is eluted from the composition in situ.

The agents may be adsorbed onto and incorporated into the biodegradable nanostructure surface, by dipping the implant into a solution or dispersion containing the agents and/or additives, or by other means recognized by those skilled in the art. In some embodiments, the nanostructure will release the adsorbed biological agents and additives in a time-controlled fashion. In this way, the therapeutic advantages imparted by the addition of biological agents and additives may be continued for an extended period of time.

The nanotube modified implant is capable of delivering an agent for the treatment of a disease or disorder that requires controlled and/or localized drug delivery over some period of time (e.g., 1, 3, 5, 7 days; 2, 3, 4 weeks; 1, 2, 3, 6, 12 months). Desirably, the nanotube modified implant comprises an effective amount of one or more antibiotics, growth factors that promote cell growth, statins that promote bone growth, small molecules, or cartilage or bone repair agents. Preferably, the nanotube modified implant comprises at least about 1 μg, 25 μg, 50 μg, 100 μg, 250 μg, 500 μg, 750 μg, 1 mg, 5 mg, 10 mg, 25 mg, 50 mg, 75 mg, 100 mg, 200 mg, 250 mg, 300 mg, 400 mg, or 500 mg of an agent (e.g., an antibiotic). In another embodiment, the composition releases at least about 1 μg, 25 μg, 50 μg, 100 μg, 250 μg, 500 μg, 750 μg, 1 mg, 5 mg, 10 mg, 25 mg, 50 mg, 75 mg, 100 mg, 200 mg, 250 mg, 300 mg, 400 mg, or 500 mg of an agent (e.g., an antibiotic) over the course of at least about 1, 2, 3, 4, 5, 6, 7, 8, 9, 10, 14, 21, 28, or 35 days. In still another embodiment, the composition comprises at least about 1 μg, 25 μg, 50 μg, 100 μg, 250 μg, 500 μg, 750 μg, 1 mg, 5 mg, 10 mg, 25 mg, 50 mg, 75 mg, 100 mg, 200 mg, 250 mg, 300 mg, 400 mg, or 500 mg of an agent (e.g., an antibiotic) per $cm^3$.

Anti-Inflammatories

In other embodiments, a nanotube modified implant is used to deliver an anti-inflammatory agent. Such anti-inflammatory agents include, but are not limited to, Alclofenac; Alclometasone Dipropionate; Algestone Acetonide; Alpha Amylase; Amcinafal; Amcinafide; Amfenac Sodium; Amiprilose Hydrochloride; Anakinra; Anirolac; Anitrazafen; Apazone; Balsalazide Disodium; Bendazac; Benoxaprofen; Benzydamine Hydrochloride; Bromelains; Broperamole; Budesonide; Carprofen; Cicloprofen; Ciclsporin, Cintazone; Cliprofen; Clobetasol Propionate; Clobetasone Butyrate; Clopirac; Cloticasone Propionate; Cormethasone Acetate; Cortodoxone; Curcumin; Deflazacort; Desonide; Desoximetasone; Dexamethasone Dipropionate; Diclofenac Potassium; Diclofenac Sodium; Diflorasone Diacetate; Diflumidone Sodium; Diflunisal; Difluprednate; Diftalone; Dimethyl Sulfoxide; Drocinonide; Endrysone; Enlimomab; Enolicam Sodium; Epirizole; Etodolac; Etofenamate; Felbinac; Fenamole; Fenbufen; Fenclofenac; Fenclorac; Fendosal; Fenpipalone; Fentiazac; Flazalone; Fluazacort; Flufenamic Acid; Flumizole; Flunisolide Acetate; Flunixin; Flunixin Meglumine; Fluocortin Butyl; Fluorometholone Acetate; Fluquazone; Flurbiprofen; Fluretofen; Fluticasone Propionate; Furaprofen; Furobufen; Halcinonide; Halobetasol Propionate; Halopredone Acetate; Ibufenac; Ibuprofen; Ibuprofen Aluminum; Ibuprofen Piconol; Ilonidap; Indomethacin; Indomethacin Sodium; Indoprofen; Indoxole; Intrazole; Isoflupredone Acetate; Isoxepac; Isoxicam; Ketoprofen; Lofemizole Hydrochloride; Lornoxicam; Loteprednol Etabonate; Meclofenamate Sodium; Meclofenamic Acid; Meclorisone Dibutyrate; Mefenamic Acid; Mesalamine; Meseclazone; Methylprednisolone Suleptanate; Morniflumate; Nabumetone; Naproxen; Naproxen Sodium; Naproxol; Nimazone; Olsalazine Sodium; Orgotein; Orpanoxin; Oxaprozin; Oxyphenbutazone; Paranyline Hydrochloride; Pentosan Polysulfate Sodium; Phenbutazone Sodium Glycerate; Pirfenidone; Piroxicam; Piroxicam Cinnamate; Piroxicam Olamine; Pirprofen; Prednazate; Prifelone; Prodolic Acid; Proquazone; Proxazole; Proxazole Citrate; Rimexolone; Romazarit; Salcolex; Salnacedin; Salsalate; Sanguinarium Chloride; Seclazone; Sermetacin; Sudoxicam; Sulindac; Suprofen; Talmetacin; Talniflumate; Talosalate; Tebufelone; Tenidap; Tenidap Sodium; Tenoxicam; Tesicam; Tesimide; Tetrydamine; Tiopinac; Tixocortol Pivalate; Tolmetin; Tolmetin Sodium; Triclonide; Triflumidate; Zidometacin; and Zomepirac Sodium.

Growth Factors

In other embodiments, a nanotube modified implant is used to deliver a growth factor. Growth factors are typically polypeptides or fragments thereof that support the survival, growth, or differentiation of a cell. A nanotube modified implant described herein can be used to deliver virtually any growth factor known in the art. Such growth factors include but are not limited to angiopoietin, acidic fibroblast growth factors (aFGF) (GenBank Accession No. NP_149127) and basic FGF (GenBank Accession No. AAA52448), bone morphogenic protein (BMP)(GenBank Accession No. BAD92827), vascular endothelial growth factor (VEGF) (GenBank Accession No. AAA35789 or NP_001020539), epidermal growth factor (EGF)(GenBank Accession No. NP_001954), transforming growth factor α (TGF-α) (GenBank Accession No. NP_003227) and transforming growth factor β (TFG-β) (GenBank Accession No. 1109243A), platelet-derived endothelial cell growth factor (PD-ECGF) (GenBank Accession No. NP_001944), platelet-derived growth factor (PDGF)(GenBank Accession No. 1109245A), tumor necrosis factor α (TNF-α)(GenBank Accession No. CAA26669), hepatocyte growth factor (HGF)(GenBank Accession No. BAA14348), insulin like growth factor (IGF) (GenBank Accession No. P08833), erythropoietin (GenBank Accession No. P01588), colony stimulating factor (CSF), macrophage-CSF (M-CSF)(GenBank Accession No. AAB59527), granulocyte/macrophage CSF (GM-CSF) (GenBank Accession No. NP_000749) and nitric oxide synthase (NOS)(GenBank Accession No. AAA36365). In one preferred embodiment, the growth factor is BMP. In another embodiment, the agent is a statin that promotes bone growth. Exemplary statins include but are not limited to simvastatin, atorvastatin (Lipitor), cerivastatim, fluvastatin, lovastatin, and pravastatin.

Antimicrobial Agents

*Staphylococcus aureus, staphylococcus epidermidis*, and *Pseudomonas aeruginosa* are pathogens that are commonly present at musculoskeletal wound sites. *S. aureus* is often associated with prosthetic joint infection. The invention provides nanotube modified orthopedic implants useful in treating or preventing infection at a site of trauma. Any antimicrobial agent known in the art can be used in the nanotube modified implants of the invention at concentrations generally used for such agents.

Antimicrobial agents useful in nanotube compositions of the invention include but are not limited to antibacterials, antifungals, and antivirals. An antimicrobial agent as used herein is an agent which reduces or stabilizes the survival, growth, or proliferation of a pathogen. Antimicrobial agents include but are not limited to Aztreonam; Chlorhexidine Gluconate; Imidurea; Lycetamine; Nibroxane; Pirazmonam Sodium; Propionic Acid; Pyrithione Sodium; Sanguinarium Chloride; Tigemonam Dicholine; Acedapsone; Acetosulfone Sodium; Alamecin; Alexidine; Amdinocillin; Amdinocillin Pivoxil; Amicycline; Amifloxacin; Amifloxacin Mesylate; Amikacin; Amikacin Sulfate; Aminosalicylic acid; Aminosalicylate sodium; Amoxicillin; Amphomycin; Ampicillin; Ampicillin Sodium; Apalcillin Sodium; Apramycin; Aspartocin; Astromicin Sulfate; Avilamycin; Avoparcin; Azithromycin; Azlocillin; Azlocillin Sodium; Bacampicillin Hydrochloride; Bacitracin; Bacitracin Methylene Disalicylate; Bacitracin Zinc; Bambermycins; Benzoylpas Calcium; Berythromycin; Betamicin Sulfate; Biapenem; Biniramycin; Biphenamine Hydrochloride; Bispyrithione Magsulfex; Butikacin; Butirosin Sulfate; Capreomycin Sulfate; Carbadox; Carbenicillin Disodium; Carbenicillin Indanyl Sodium; Carbenicillin Phenyl Sodium; Carbenicillin Potassium; Carumonam Sodium; Cefaclor; Cefadroxil; Cefamandole; Cefamandole Nafate; Cefamandole Sodium; Cefaparole; Cefatrizine; Cefazaflur Sodium; Cefazolin; Cefazolin Sodium; Cefbuperazone; Cefdinir; Cefepime; Cefepime Hydrochloride; Cefetecol; Cefixime; Cefinenoxime Hydrochloride; Cefmetazole; Cefmetazole Sodium; Cefonicid Monosodium; Cefonicid Sodium; Cefoperazone Sodium; Ceforanide; Cefotaxime Sodium; Cefotetan; Cefotetan Disodium; Cefotiam Hydrochloride; Cefoxitin; Cefoxitin Sodium; Cefpimizole; Cefpimizole Sodium; Cefpiramide; Cefpiramide Sodium; Cefpirome Sulfate; Cefpodoxime Proxetil; Cefprozil; Cefroxadine; Cefsulodin Sodium; Ceftazidime; Ceftibuten; Ceftizoxime Sodium; Ceftriaxone Sodium; Cefuroxime; Cefuroxime Axetil; Cefuroxime Pivoxetil; Cefuroxime Sodium; Cephacetrile Sodium; Cephalexin; Cephalexin Hydrochloride, Cephaloglycin; Cephaloridine; Cephalothin Sodium; Cephapirin Sodium; Cephradine; Cetocycline Hydrochloride; Cetophenicol; Chloramphenicol; Chloramphenicol Palmitate; Chloramphenicol Pantothenate Complex; Chloramphenicol Sodium Succinate; Chlorhexidine Phosphanilate; Chloroxylenol; Chlortetracycline Bisulfate; Chlortetracycline Hydrochloride; Cinoxacin; Ciprofloxacin; Ciprofloxacin Hydrochloride; Cirolemycin; Clarithromycin; Clinafloxacin Hydrochloride; Clindamycin; Clindamycin Hydrochloride; Clindamycin Palmitate Hydrochloride; Clindamycin Phosphate; Clofazimine; Cloxacillin Benzathine; Cloxacillin Sodium; Cloxyquin; Colistimethate Sodium; Colistin Sulfate; Coumermycin; Coumermycin Sodium; Curcumin; Cyclacillin; Cycloserine; Dalfopristin; Dapsone; Daptomycin; Demeclocycline; Demeclocycline Hydrochloride; Demecycline; Denofungin; Diaveridine; Dicloxacillin; Dicloxacillin Sodium; Dihydrostreptomycin Sulfate; Dipyrithione; Dirithromycin; Doxycycline; Doxycycline Calcium; Doxycycline Fosfatex; Doxycycline Hyclate; Droxacin Sodium; Enoxacin; Epicillin; Epitetracycline Hydrochloride; Erythromycin; Erythromycin Acistrate; Erythromycin Estolate; Erythromycin Ethylsuccinate; Erythromycin Gluceptate; Erythromycin Lactobionate; Erythromycin Propionate; Erythromycin Stearate; Ethambutol Hydrochloride; Ethionamide; Fleroxacin; Floxacillin; Fludalanine; Flumequine; Fosfomycin; Fosfomycin Tromethamine; Fumoxicillin; Furazolium Chloride; Furazolium Tartrate; Fusidate Sodium; Fusidic Acid; Gentamicin Sulfate; Gloximonam; Gramicidin; Haloprogin; Hetacillin; Hetacillin Potassium; Hexedine; Ibafloxacin; Imipenem; Isoconazole; Isepamicin; Isoniazid; Josamycin; Kanamycin Sulfate; Kitasamycin; Levofuraltadone; Levopropylcillin Potassium; Lexithromycin; Lincomycin; Lincomycin Hydrochloride; Lomefloxacin; Lomefloxacin Hydrochloride; Lomefloxacin Mesylate; Loracarbef; Mafenide; Meclocycline; Meclocycline Sulfosalicylate; Megalomicin Potassium Phosphate; Mequidox; Meropenem; Methacycline; Methacycline Hydrochloride; Methenamine; Methenamine Hippurate; Methenamine Mandelate; Methicillin Sodium; Metioprim; Metronidazole Hydrochloride; Metronidazole Phosphate; Mezlocillin; Mezlocillin Sodium; Minocycline; Minocycline Hydrochloride; Mirincamycin lydrochloride; Monensin; Monensin Sodium; Nafcillin Sodium; Nalidixate Sodium; Nalidixic Acid; Natamycin; Nebramycin; Neomycin Palmitate; Neomycin Sulfate; Neomycin Undecylenate; Netilmicin Sulfate; Neutramycin; Nifuradene; Nifuraldezone; Nifuratel; Nifuratrone; Nifurdazil; Nifurimide; Nifurpirinol; Nifurquinazol; Nifurthiazole; Nitrocycline; Nitrofurantoin; Nitromide; Norfloxacin; Novobiocin Sodium; Ofloxacin; Ormetoprim; Oxacillin Sodium; Oximonam; Oximonam Sodium; Oxolinic Acid; Oxytetracycline; Oxytetracycline Calcium; Oxytetracycline Hydrochloride; Paldimycin; Parachlorophenol; Paulomycin; Pefloxacin; Pefloxacin Mesylate; Penamecillin; Penicillin G Benzathine; Penicillin G Potassium; Penicillin G Procaine; Penicillin G Sodium; Penicillin V; Penicillin V Benzathine; Penicillin V Hydrabamine; Penicillin V Potassium; Pentizidone Sodium; Phenyl Aminosalicylate; Piperacillin Sodium; Pirbenicillin Sodium; Piridicillin Sodium; Pirlimycin Hydrochloride; Pivampicillin Hydrochloride; Pivampicillin Pamoate; Pivampicillin Probenate; Polymyxin B Sulfate; Porfiromycin; Propikacin; Pyrazinamide; Pyrithione Zinc; Quindecamine Acetate; Quinupristin; Racephenicol; Ramoplanin; Ranimycin; Relomycin; Repromicin; Rifabutin; Rifametane; Rifamexil; Rifamide; Rifampin; Rifapentine; Rifaximin; Rolitetracycline; Rolitetracycline Nitrate; Rosaramicin; Rosaramicin Butyrate; Rosaramicin Propionate; Rosaramicin Sodium Phosphate; Rosaramicin Stearate; Rosoxacil; Roxarsone; Roxithromycin; Sancycline; Sanfetrinem Sodium; Sarmoxicillin; Sarpicillin; Scopafungin; Sisomicin; Sisomicin Sulfate; Sparfloxacin; Spectinomycin Hydrochloride; Spiramycin; Stallimycin Hydrochloride; Steffimycin; Streptomycin Sulfate; Streptonicozid; Sulfabenz: Sulfabenzamide; Sulfacetamide; Sulfacetamide Sodium; Sulfacytine; Sulfadiazine; Sulfadiazine Sodium; Sulfadoxine; Sulfalene; Sulfamerazine; Sulfameter; Sulfamethazine; Sulfamethizole; Sulfamethoxazole; Sulfamonomethoxine; Sulfamoxole; Sulfanilate Zinc; Sulfanitran; Sulfasalazine; Sulfasomizole; Sulfathiazole; Sulfazamet; Sulfisoxazole; Sulfisoxazole Acetyl; Sulfisoxazole Diolamine; Sulfomyxin; Sulopenem; Sultamicillin; Suncillin Sodium; Talampicillin Hydrochloride; Teicoplanin; Temafloxacin Hydrochloride; Temocillin; Tetracycline; Tetracycline Hydrochloride; Tetracycline Phosphate Complex; Tetroxoprim; Thiamphenicol; Thiphencillin Potassium; Ticarcillin Cresyl Sodium: Ticarcillin Disodium; Ticarcillin Monosodium; Ticlatone; Tiodonium Chloride; Tobramycin; Tobramycin Sulfate; Tosufloxacin; Trimethoprim; Trimethoprim Sulfate; Trisulfapyrimidines; Troleandomycin; Trospectomycin Sulfate; Tyrothricin; Vancomycin; Vancomycin Hydrochloride; Virginiamycin; Zorbamycin; Difloxacin Hydrochloride; Lauryl Isoquinolinium Bromide; Moxalactam Disodium; Ornidazole; Pentisomicin; and Sarafloxacin Hydrochloride.

Delivery of Nanotube Compositions

Nanotube modified implants can be delivered by any method known to the skilled artisan. In one approach, a nanotube modified implant is surgically implanted at a site where a dental implant, orthopedic implant, cardiovascular implant, neurological implant, neurovascular implant, gastrointestinal implant, muscular implant, cochlear implant, and ocular implant is required. If desired, the nanotube modified implant is loaded with one or more antibiotics or other biologically active agents by a clinician. In one embodiment, a biologically active agent is loaded into nanotube by placing the implant into a vacuum chamber that also has the capability of depositing the agents onto the surface. Devices for vacuum depositing compounds on surfaces are known in the art. As the vacuum is slowly decreased toward ambient pressure the agent is deposited into the nanotube.

Kits

The invention provides kits that include nanotube modified implants. In one embodiment, the kit includes a nanotube modified implant containing a therapeutic or prophylactic agent that that prevents or treats infection (e.g., an antimicrobial agent) or that promotes healing (e.g., growth factor, anti-inflammatory, clot promoting agent, anti-thrombotic). In some embodiments, the kit comprises a sterile container which contains a nanotube modified implant; such containers can be boxes, ampoules, bottles, vials, tubes, bags, pouches, blister-packs, or other suitable container forms known in the art. Such containers can be made of plastic, glass, laminated paper, metal foil, or other materials suitable for holding medicaments.

If desired a nanotube modified implant of the invention is provided together with instructions for using it in a prophylactic or therapeutic method described herein. The instructions will generally include information about the use of the composition for the treatment of a trauma, infection or related disease in a subject in need thereof. The instructions may be printed directly on the container (when present), or as a label applied to the container, or as a separate sheet, pamphlet, card, or folder supplied in or with the container.

Electrochemical Etching Device and System

The invention provides a device for selectively modifying a surface to generate nanotubes. In one embodiment, the device features one or more cathodes (e.g., graphite), one or more anodes (e.g., graphite) and a titanium or titanium alloy surface in an electrolyte solution, wherein the anode is in proximity to the surface; at least one power supply in electrical communication with the cathode and anode(s), such that when voltage is applied in the presence of an electrolyte solution nanotubes are formed on the surface; and a support for positioning the cathode and one or more anodes relative to the surface. In one embodiment, the cathode and/or anodes are point or cylindrical electrodes that can be positioned relative to selected sites on the surface. In another embodiment, the distance of the cathode and/or anodes relative to the surface is varied, the voltage applied is varied, and the duration for which the voltage is applied is varied. The voltage, time, and distances are selected to form nanotubes whose length and/or diameter differs between sites on the surface.

The invention provides an automated system for etching a titanium or titanium alloy surface to form nanotubes at one or more selected sites on the surface. In one embodiment, the device features a support for positioning the cathode and one or more anodes relative to a titanium or titanium alloy surface; a cathode and one or more anodes in electrical communication with said power supply; wherein when voltage is applied in the presence of an electrolyte solution nanotubes are formed at selected sites on the surface; and a control device for detecting the electrical resistance and current within the system, wherein the control device is configured to controllably adjust the distances, voltages, and times used to form nanotubes at selected sites on the surface.

If the etching electrical current is measured to very high precision over time the current within the system can serve as a feedback signal to the automated machine control system correlating with one or more of the following: nanotube diameter, nanotube length, projected area of titanium removed between nanotubes and within their inner diameter, and volume of titanium removed from between nanotubes and within their inner diameter. This feedback signal automatically alters electrode position, distance from the surface, voltage, and the time for which the voltage is applied to achieve nanotubes having the desired dimensions, mechanical stiffness, or other properties.

The following examples are put forth so as to provide those of ordinary skill in the art with a complete disclosure and description of how to make and use the assay, screening, and therapeutic methods of the invention, and are not intended to limit the scope of what the inventors regard as their invention.

EXAMPLES

Example 1

Ti Nanotube Fabrication Using Anodization

Nanotubes were fabricated onto/into the surface of pure and Ti6Al4V titanium sheets and Ti6Al4V ELI orthopedic hardware by anodization. Titanium and titanium alloy surfaces comprising nanotubes were studied for the purpose of enhancing cell growth and adhesion on titanium surfaces. Methods were developed to fabricate the nanotubular structures on titanium surfaces.

$TiO_2$ nanotubes were synthesized from titanium substrates using anodization. The fabrication process used an etching set-up involving a Ti anode, a counter electrode; electrolyte, and a DC power source (FIG. 1). The substrates for nanotube etching were flat, 2 cm×3 cm and 0.25 mm thick, and polished with 0.06 mm colloidal $SiO_2$. Prior to nanotube etching, the substrates were sequentially sonicated in acetone, isopropyl alcohol, and methanol, then rinsed with deionized water, and dried in an $N_2$ stream. The experimental setup consisted of a two-electrode arrangement. Four different metals (platinum, stainless steel, copper, and graphite) were used as the counter electrodes for four different sets of anodizations. The spacing between the substrates and the counter electrode was approximately 25 mm. The anodization was carried out at room temperature. The electrolyte was 0.2 wt % solution of $NH_4F$ in 49 ml ethylene glycol and 1 ml deionized water (49 mL ethylene glycol, 1 mL water, and 0.33 grams of ammonium fluoride). The electrolyte used is benign compared to previously reported electrolytes of hydrofluoric acid and nitric acid. The innocuous etching electrolyte ($NH_4F$ and ethylene glycol rather than HF), makes the process considerably safer, cheaper, and easier to maintain by eliminating the need for costly specialized environmental containment and disposal safeguards. Additionally, it ensures that any residual chemical etchant that might cling to the product surface would be essentially benign. A constant 60 V DC was used for all experiments. After anodization, the samples were rinsed with deionized water and dried in a $N_2$ stream.

Figure 2:
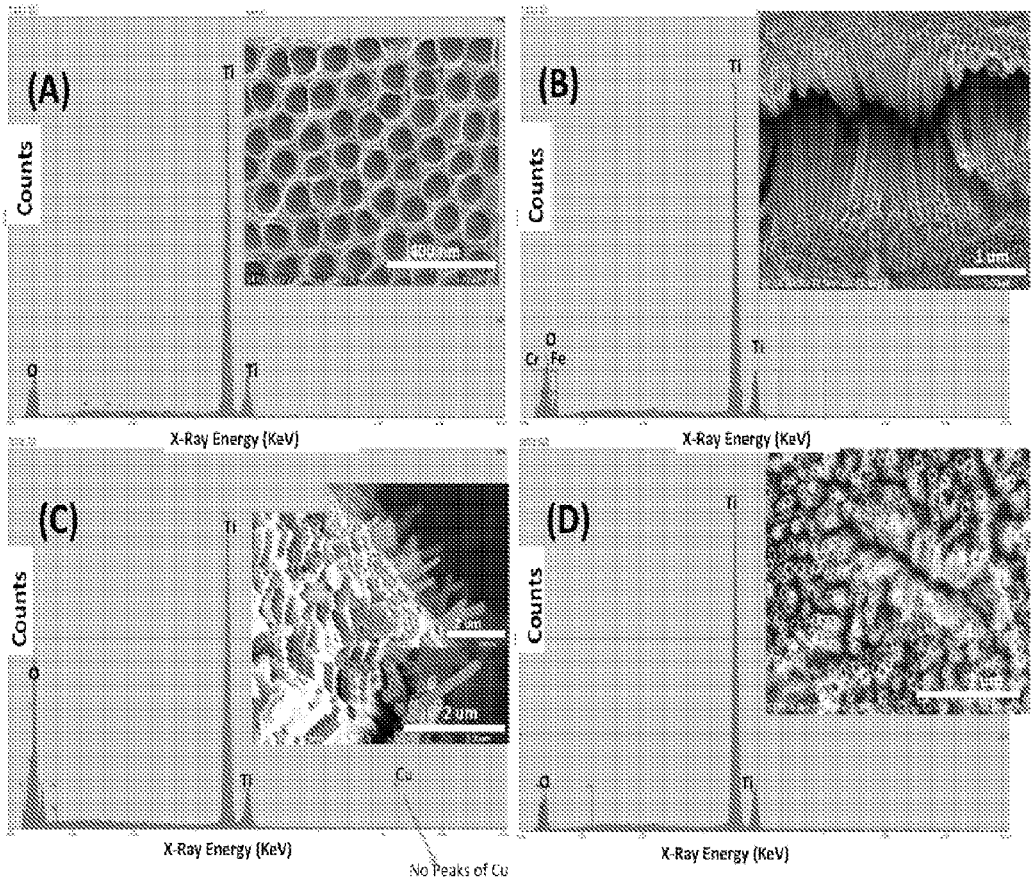
FIG. 2 shows SEM images of nanotubes etched with different counter electrodes and their corresponding EDS analysis: Pt electrode (FIG. 2A), Stainless steel electrode (FIG. 2B), Cu electrode (FIG. 2C), and Graphite electrode (FIG. 2D).

Nanotubes formed by different counter electrodes were analyzed by scanning electron microscopy (SEM) and energy-dispersive X-ray spectroscopy (EDS) (FIGS. 2A-2B). SEM analysis showed nanotubes were formed when commercially pure (cp) Ti was used as anode and Pt as counter electrode (FIG. 2A). As shown by the EDS analysis, $TiO_2$ nanotubes using Pt as counter electrode were pure with no traces of other elements. SEM analysis showed nanotubes were formed when cp Ti was used as anode and stainless steel as the counter electrode (FIG. 2B). As shown by the EDS analysis, $TiO_2$ nanotubes using stainless steel as counter electrode have some traces of Fe and Cr and are not pure. SEM analysis showed nanotubes were formed when cp Ti was used as anode and Cu as counter electrode (FIG. 2C). As shown by the EDS analysis, $TiO_2$ nanotubes formed using copper as the counter electrode are pure with no traces of Cu element. SEM analysis showed nanotubes were formed when cp Ti was used as anode and graphite as counter electrode (FIG. 2D). As shown by the EDS analysis, $TiO_2$ nanotubes using graphite as counter electrode are pure with no traces of other elements.

Taking into consideration the fact that Pt is an expensive metal, substituting Pt in the counter electrode has the potential to reduce the cost of nanotube fabrication. Moreover, materials other than Pt may provide additional advantages. For example, graphite can also be easily shaped into a point electrode, thus, allowing the use of multiple graphite counter electrodes. Additionally, replacing a single Pt electrode with multiple and individually addressable graphite electrodes significantly lowers the operating cost of the process (over 5000× electrode price differential) while increasing versatility.

Figure 3:
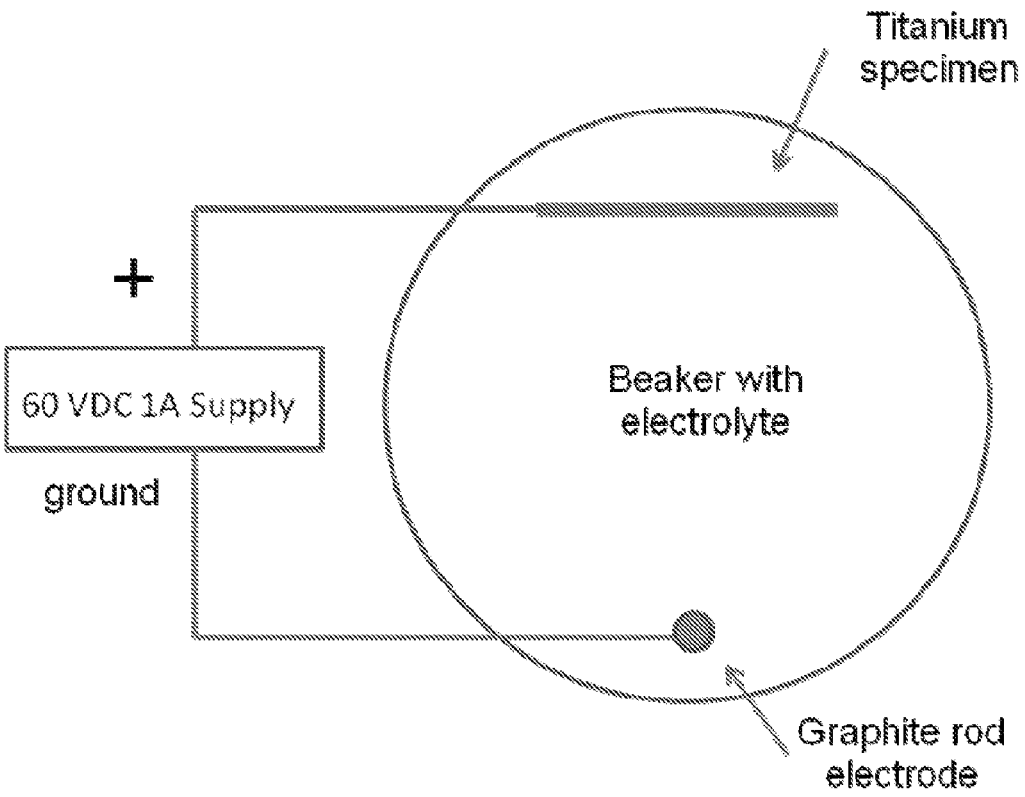
FIG. 3 is a schematic diagram showing a basic electrochemical nanotube fabrication apparatus.
Figure 4A:
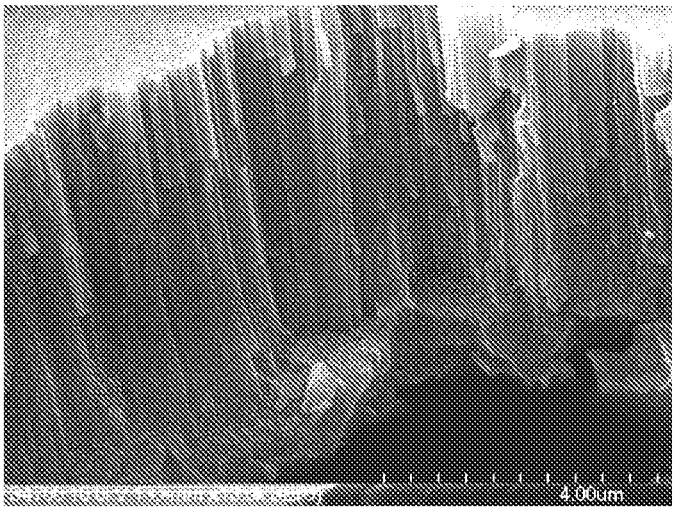
FIGS. 4A and 4B are images showing nanotubes etched with graphite electrodes produced according to methods of the invention. Nanotubes etched with graphite cylindrical electrode (FIG. 4A) were longer than nanotubes etched with graphite point electrode (FIG. 4B). Nanotubes etched with a graphite point electrode have a length useful for orthopedic applications.
Figure 4B:
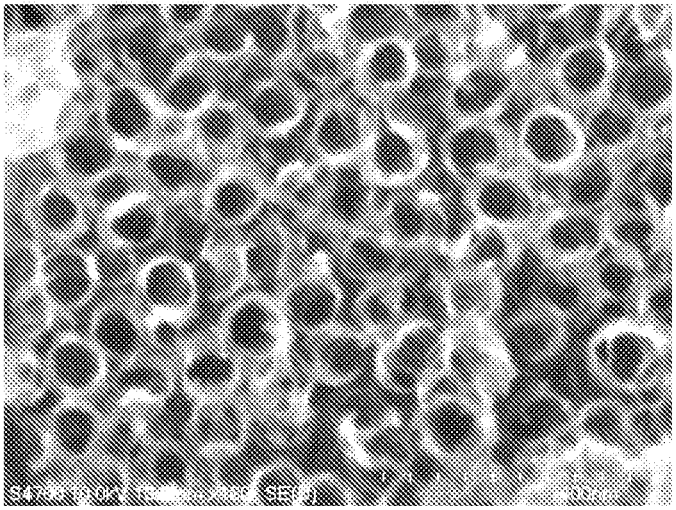
Figure 5A:
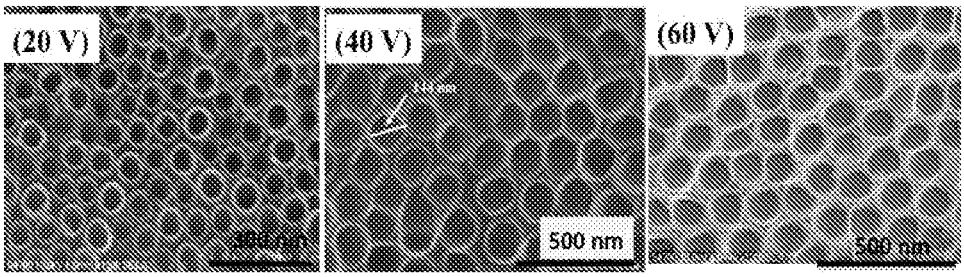
FIGS. 5A and 5B show that varying diameters of $TiO_2$ nanotubes can be produced using methods of the invention.
Figure 5B:
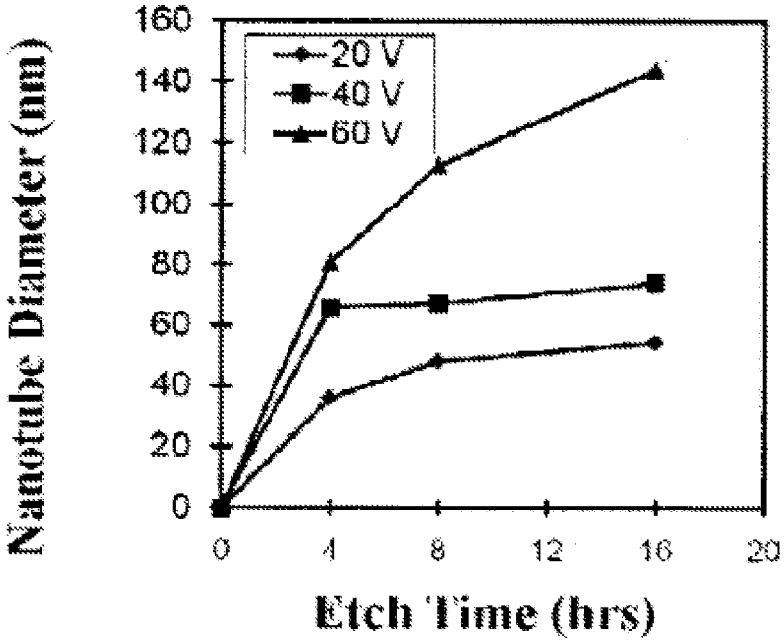

Due to the very high cost of platinum and the undesirable effects of stainless steel and copper electrodes, graphite was chosen for all future work. In a typical apparatus whereby uniform nanotubular structures are produced on a titanium specimen, the platinum specimen is connected to +60 VDC and the graphite electrode is connected to electrical ground (FIG. 3). The platinum and graphite electrode are placed in the ammonium fluoride electrolyte and the circuit is energized. Typical nanotubular structures were produced under these fabrication conditions using graphite electrodes (FIG. 4). Additionally, under this apparatus configuration, reproducible results with quantifiable relationships among anodization time, voltage, electrode standoff distance and geometric complexity of the implant surface were obtained. Surface morphologies ranged from continuous and porous to multiple and independent vertical nanotubes (FIGS. 5A and 5B). Voltage/time data indicate aspect ratio & tube wall conditions can be controlled (Table 1).

TABLE 1

Effect of anodization time and voltage on $TiO_2$ nanotube length.

| | Time | | |
|---|---|---|---|
| Voltage | 4 Hrs | 8 Hrs | 16 Hrs |
| 20 V | 589 nm | 1,070 nm | 1,388 nm |
| 40 V | 1,443 nm | 4,530 nm | 6,114 nm |
| 60 V | 5,493 nm | 6,754 nm | 10,075 nm |

Thus, nanotubular structures were fabricated using inexpensive graphite cylindrical rods (rod electrodes) and electrically insulating coated graphite rods leaving only the tip uncoated (point electrodes) in place of expensive platinum sheet electrodes. The nanotubular structures were fabricated using a separation distance between the titanium and graphite that can vary from close proximity to up to 100 mm, without limitation. Ti nanotubes were quickly fabricated with increasing anodization voltage up to +60 VDC.

Example 2

Nanotube Annealing Increases Wettability of $TiO_2$ Nanotube Surfaces

Figure 6A:
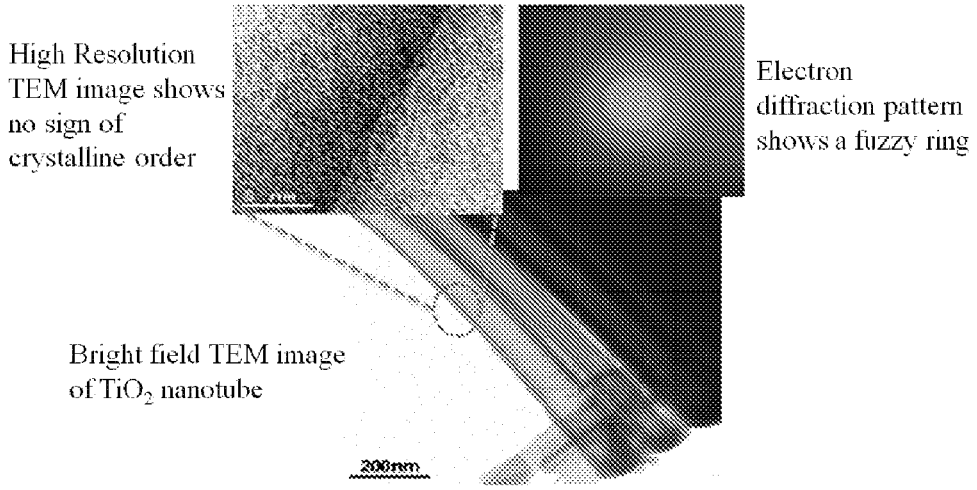
FIGS. 6A and 6B depict transmission electron microscopy (TEM) images of $TiO_2$ nanotube surfaces (TNT) structured surfaces. As-synthesized nanotubes are amorphous (FIG. 6A), and annealed nanotubes are crystalline (FIG. 6B).
Figure 6B:
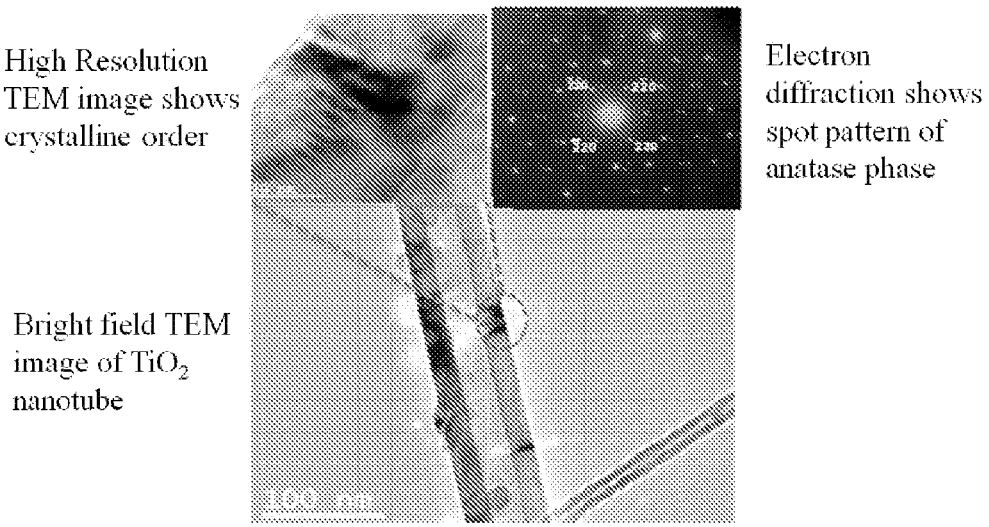

This study examined the effect of annealing and ageing on the wettability of $TiO_2$ nanotube surfaces (TNT) fabricated by anodization. The wettability of a surface is important in aqueous cell growth since a hydrophobic (non-wettable) surface will repel water and cause it to bead-up. Commercially pure and grade-5 (Ti6Al4V) titanium alloy foils were used to fabricate $TiO_2$ nanotubes. Post-anodization thermal treatment was at 450° C. using a rapid thermal annealer. A heating/cooling rate of 308° C./min was used, and the substrates were annealed in air at 450° C. for 3 hours. The annealing treatment resulted in phase transformation of nanotubes from amorphous to crystalline anatase. Thermally treated surfaces were analyzed by TEM and compared to surfaces without treatment (FIGS. 6A-6B). Thermally treated surfaces had annealed $TiO_2$ nanotubes compared to surfaces without treatment, which had amorphous nanotubes.

Water droplets (one-microliter) were used to define the wettability of the TNT surfaces by measuring the contact angles. One-microliter of de-ionized (DI) water was slowly deposited on the surfaces by a screw syringe. The experiments were repeated five times for each measurement. The temperature and humidity were maintained at 24±0.5° C. and 21±1%, respectively. Prior to the experiments, droplet deposition was repeatedly tested to ensure that the water droplets had consistent shapes.

Figure 7A:
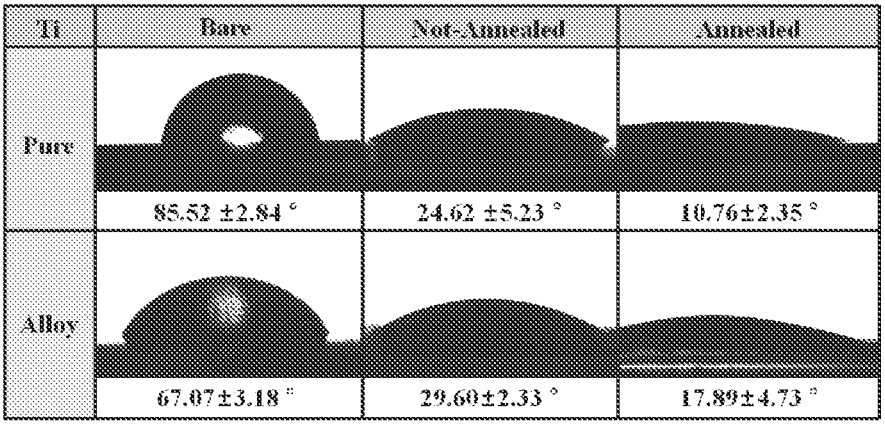
FIGS. 7A and 7B depict the wettability of $TiO_2$ nanotube surfaces. Representative image comparison of the initial contact angles.

During the experiment, a droplet was dynamically recorded on an image capturing system via a CCD camera. Water droplets were placed on bare Ti foil, pure TNT, and alloy TNT in as-synthesized and annealed conditions (FIG. 7A). Images of droplets on the surfaces were captured five to ten times for each case and the corresponding contact angles calculated. A digital image analysis algorithm was developed to obtain contact angles, contact radii, and center-heights of the droplets on the nanotube surfaces.

Figure 7B:
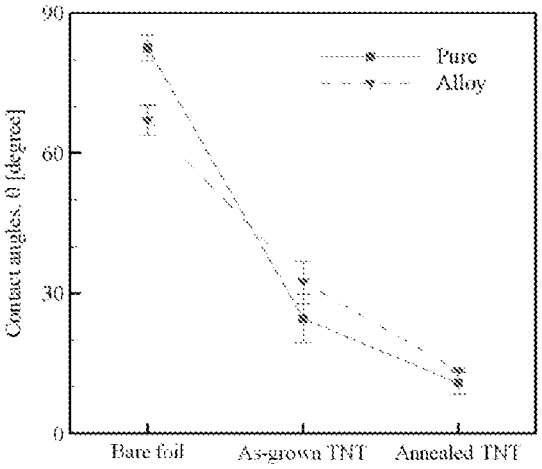

Data were plotted to show the trend of the contact angle variation (FIG. 7B). Three observations were made from the wettability experiments. The first was the difference between the contact angles of the bare pure and bare alloy titanium foils. In the case of pure titanium, the contact angles were larger than the alloy. Second, it was found that the creation of TNT structures made the surface more hydrophilic. In all cases after the anodization process, the droplet contact angles decreased in the range of 55~70% compared to the contact angles of each bare foil. The third phenomenon was that the annealing made the TNT surfaces super-hydrophilic. In general, annealing metal generates a hydrophobic surface. Surprisingly and unexpectedly, annealing produced super-hydrophilic surfaces. The water droplet contact angles on the annealed TNT surfaces decreased 40~56% compared to the as-anodized TNT surface cases. The annealing resulted in nanotubes of anatase causing super-hydrophilic surfaces to be generated.

Figure 8:
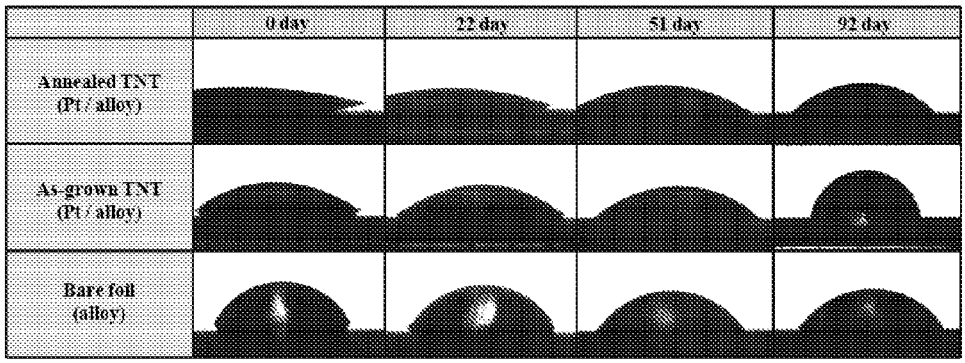
FIG. 8 shows a comparison of the time-dependent change of surface wettability of $TiO_2$ nanotube surfaces. Annealed TNT (Pt/alloy), As-grown TNT (Pt/alloy), and bare foil (alloy) were compared. As time passed, the TNT surface hydrophobicity increased.

The effect of ageing of the TNT surfaces on wettability was examined during and after three months (FIG. 8). Water droplets were placed on bare titanium, as-anodized TNT, and annealed TNT after ageing. For the TNT surfaces, it was found that the surface wettabilities changed from hydrophilic to hydrophobic or from super-hydrophilic to hydrophilic after ageing. All of the TNT surfaces had the same tendency and the resulting water droplet contact angles are shown in Table 2.

TABLE 2

Variation of contact angle with respect to time

| Contact angle (°) | | 0 day | 22 day | 51 day | 92 day |
|---|---|---|---|---|---|
| Annealed Pt | Pure | 10.76 | 21.85 | 23.39 | 26.94 |
| TNT | Alloy | 14.59 | 19.45 | 31.56 | 44.12 |
| As-grown Pt | Pure | 24.62 | 28.25 | 34.05 | 42.47 |
| TNT | Alloy | 32.39 | 37.97 | 42.23 | 80.35 |
| Bare | Pure | 82.52 | 74.63 | 78.66 | 81.24 |
| | Alloy | 67.07 | 54.84 | 73.48 | 56.80 |

Figure 9A:
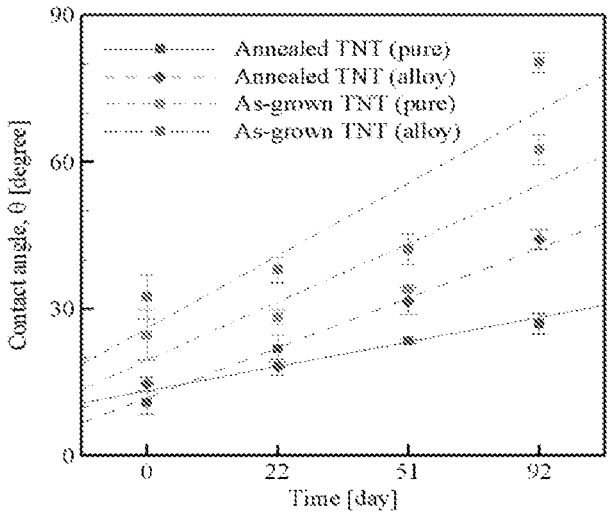
FIGS. 9A and 9B depict the comparison of the time-dependent contact angles.

The contact angle analyses were made 22, 51, and 92 days after fabrication. The hydrophobicity increased at different rates for each case, but all of the water droplet contact angles increased on the TNT structured surfaces. Data were plotted to show the variation of contact angles for the cases of the annealed and as-anodized TNT surfaces (FIG. 9A). Invariably, the results show that the surface hydrophobicity was increased for all four cases.

Figure 9B:
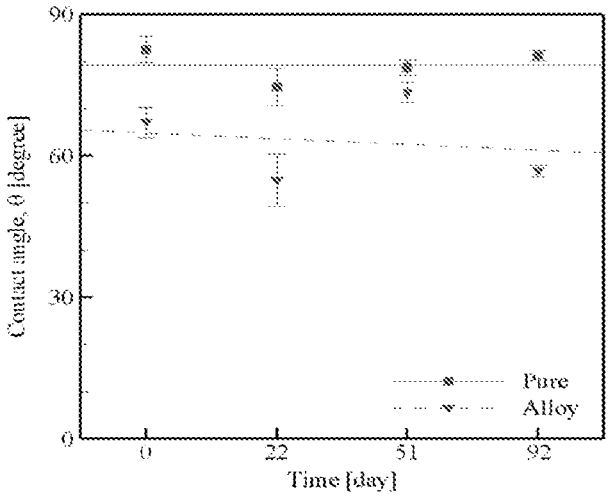

$TiO_2$ has hydrophobic characteristics. Without being bound to a particular theory, as time passed, the hydrophobicity increased. The change in the wetting behavior of $TiO_2$ porous structures provides advantages in various applications. For example, there is often high sensitivity to different wetting characteristics that affect the biological responses of protein adsorption, cell affinity or cell adhesion on a surface. For bare titanium and alloy, wettability does not change as a function of ageing (FIG. 9B). The measured contact angles of droplets remained nearly unchanged for each case. Without being bound to a particular theory, at the early stage, the contact angles decreased a small amount due to the initial oxidation of the metal. Before the experiment, the initial titanium foils were cleaned with ethanol and acetone. These samples then became oxidized through exposure to the air. An initial decrease of the contact angles was observed. However, the wettabilities of the bare titanium foils remained constant with respect to time after this initial change.

Thus, bare titanium foil is inherently hydrophobic, having an approximately 60-80 degree contact angle. Untreated $TiO_2$ nanotube surfaces (as-anodized) were more hydrophilic than titanium foil. Annealing $TiO_2$ nanotube surfaces by heat treatment further increased the hydrophilic property. However, $TiO_2$ nanotube surface became more hydrophobic when aged in air. These results indicate that where surface wettability is an advantage, using the anodization process described herein can grow nanotubes having this property. This process provides a potential application for producing orthopedic implants where the wettability characteristics of the surface can be specified.

Example 3

Nanotube Growth Inhibition with Multiple Electrodes

Using conventional electrochemical etching, nanotubular structures are fabricated on titanium surfaces by anodization. Without being bound to a particular theory, when current is applied, in the electrochemical etching apparatus an electric field emanates from a sheet electrode perpendicular to the surface of that sheet at all locations and traverse the electrolyte to the titanium specimen. The field lines enter the titanium specimen, regardless of shape, perpendicular to the localized surface at all locations on the specimen. Without being bound to a particular theory, the uniformity of these field lines at the specimen (not at the electrode) produces the fabricated nanotubular structures.

Again, without being bound to a particular theory, if the electrode is a cylindrical rod or point the field lines will emanate from that rod or point in a more concentrated manner, but will expand toward the much larger titanium specimen and enter that specimen as described above. If the electrode is extremely close to the specimen, the field lines may lack complete uniformity as they enter the specimen.

Nanotubular structures are fabricated on the specimen where the voltage potential of the specimen is higher than surrounding electrodes. This is defined as "current leaving" the specimen—that is charge is moving from a more positive voltage to a lower voltage at any location on the titanium specimen. If however, "current enters" the titanium specimen at any location, nanotube fabrication is inhibited. Under these specified fabrication conditions, the specimen may or may not be electrically connected to the electrochemical etching circuitry. The specimen may be allowed to electrically "float" (not be connected to the circuit) without imposing a particular voltage.

This innovation provides a method for locally inhibiting nanotube etching. If an electrode rod or point is placed in immediate proximity to the specimen surface, the electric field emanating from that electrode may not disperse to the entire specimen if there are other electrodes in close proximity at other voltage potentials (FIG. 10). Here, the titanium specimen is allowed to electrically float (it is not connected to the circuit).

A positive graphite rod electrode 3 mm diameter was placed 6 mm from the titanium specimen. The graphite electrode was connected to +60 VDC. The portion of the titanium sheet specimen immersed in the electrolyte was 44 mm wide by 25 mm high and was not electrically connected. A second 3 mm graphite electrode was placed on the other side of the specimen from the first electrode at a distance of 70 mm from the specimen and was connected to electrical ground. Fabrication was allowed to continue for 97 minutes. Without being bound to a particular theory, a portion of the total current flowing from the positive to the ground electrode enters the specimen on the side nearest the positive electrode. The current entering the specimen on the positive electrode side will leave the specimen as it seeks the ground potential. This leaving current will do so primarily on the ground electrode side of the specimen, but a small portion of the leaving current may leave at or near the sides of the specimen at some distance from the positive electrode. Current does not leave the specimen in the proximity of the positive electrode. Therefore, nanotube fabrication is inhibited on the side nearest the positive electrode (FIG. 11).

Figure 13:
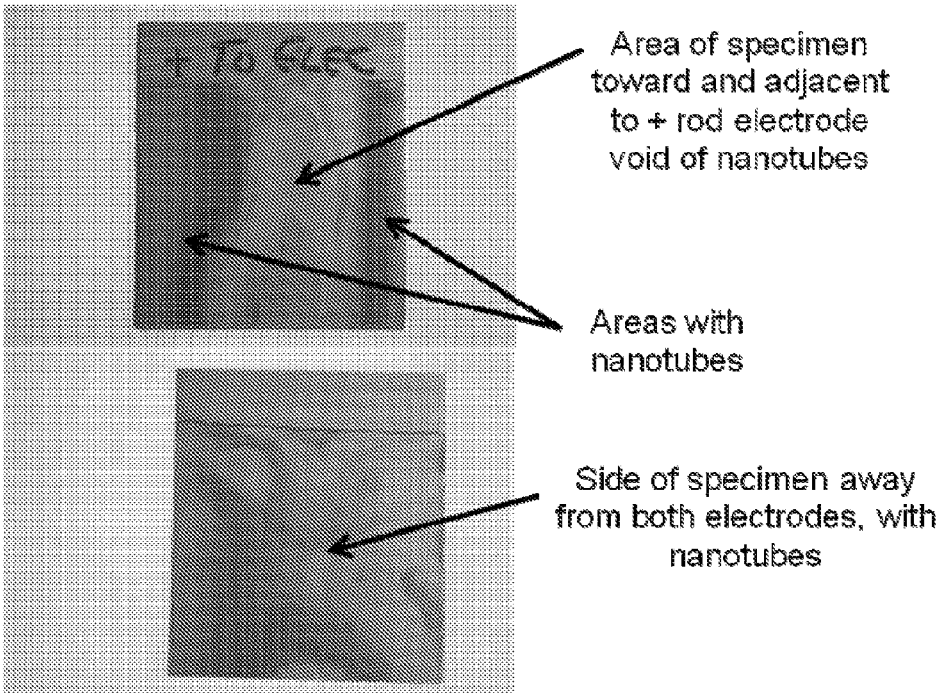
FIG. 13 depicts images of the two sides of a titanium specimen etched using a single graphite cylinder electrode to inhibit nanotube growth near the +60 VDC electrode as shown in FIG. 12.

To better understand the prior result, an experiment was conducted where the position of the titanium specimen was moved in relation to the arrangement of the electrodes (FIG. 12). The voltage was +60 VDC and the specimen was allowed to electrically float. The fabrication duration was 60 minutes. Without being bound to a particular theory, the majority of the current flows directly from the positive to the negative electrode. However, the electrolyte has a relatively low electrical conductivity owing to its chemical makeup. Therefore, a portion of the current emanating from the positive electrode flows outward and enters the specimen primarily on one side. Nanotube fabrication is inhibited over most of this proximal side (FIG. 13). However, the current entering the specimen leaves it on the opposing side and nanotube fabrication takes place (FIG. 13).

Figure 15:
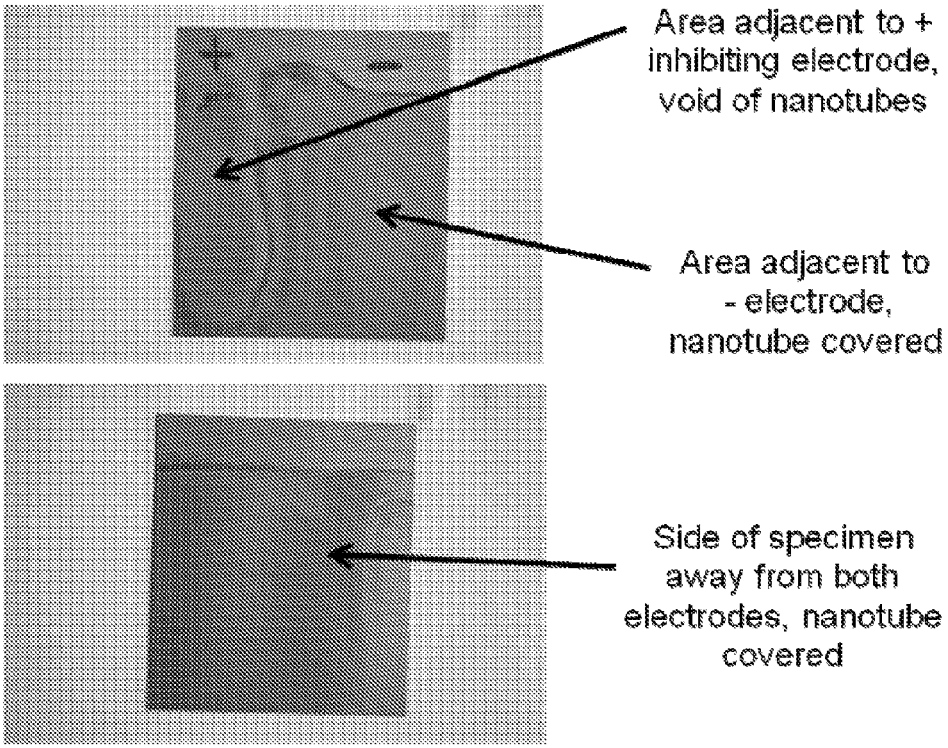
FIG. 15 depicts images of the two sides of titanium specimen etched using a single graphite cylinder electrode to inhibit nanotube growth near +60 VDC electrode in FIG. 14.

As a further demonstration, a set-up was used where the position of the titanium specimen was moved into close proximity to both electrodes (FIG. 14). The voltage was +60 VDC and the fabrication duration was 30 minutes. Without being bound to a particular theory, current enters the specimen near the positive electrode inhibiting nanotube fabrication (FIG. 15). Current leaves the specimen on the opposing side of the specimen and other locations on the electrode side that are away from the positive electrode. All of the leaving current fabricates nanotubes (FIG. 15).

From these results, using large graphite rod electrodes (typically 3 mm in diameter) and placed relatively far from the specimens (typically 6-12 mm away), it was appreciated that if the graphite electrodes are made as smaller rods or points and placed at a closer proximity, inhibiting the fabrication of nanotubes locally on the specimen surface is attained at a higher resolution of placement. It was also appreciated that if after some duration of nanotube fabrication and inhibition time, the polarity of the positive graphite electrode is made negative while at the same time the specimen polarity is made positive, then nanotubes continue to be fabricated uniformly over the entire surface providing one or more regions of relatively long nanotubes and one or more regions of shorter nanotubes, based on the total time and current flow direction of each region. Each region corresponds to one or more graphite electrodes (e.g., an array of electrodes). Specialized physical locating equipment and electrical voltage control systems that are in common commercial use can be used to achieve this type of system.

Figure 16:
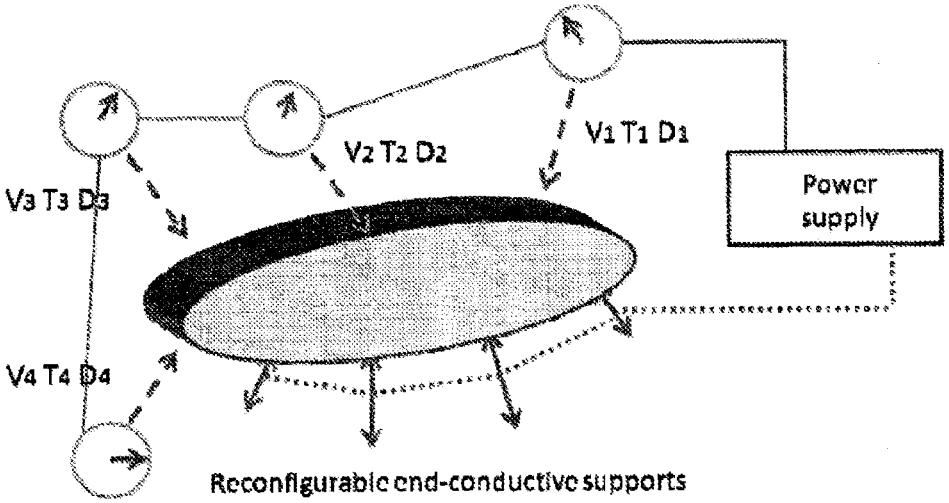
FIG. 16 is a schematic of an automated and reconfigurable nanotube etching system. Each point or rod electrode (1, 2, 3, 4, . . . , n) is supplied with an etching voltage (Vn), an etching time (Tn), and a standoff distance (Dn) for specific nanotube dimensions and mechanical stiffness.

In one embodiment, the automated system comprises an automated supporting system to hold the titanium implant (FIG. 16). The automated supporting system can support the implant from the top or can be a cradle-like structure from the bottom. In either case, the support provides electrical contact with the implant to form one side of the electrochemical etching cell. The bottom structure can be multiple independently moved pins with the locations based on the implant being processed. The geometric descriptions of implants are contained in common computer aided design (CAD) systems where the shape and extent of the surface is expressed mathematically as a series of 3-D coordinates. Knowing the implant to be processed, the system positions the supporting pins appropriately. The pins may be moved by any means of electromechanical actuation such as a ball screw or pneumatic actuation. The supports are electrically insulated except for the tip(s) which contact the implant as shown. These supports are electrically common forming the anode side of the circuit. Again, knowing the shape of the implant from the CAD (or other) representation the individually addressable point etching electrodes are positioned and energized. Based on the nanotube dimensions desired at each particular location the voltage, etch time, and standoff distance is calculated and automatically applied until the desired nanosurface is produced (see, e.g., Table 1)

Figure 29:
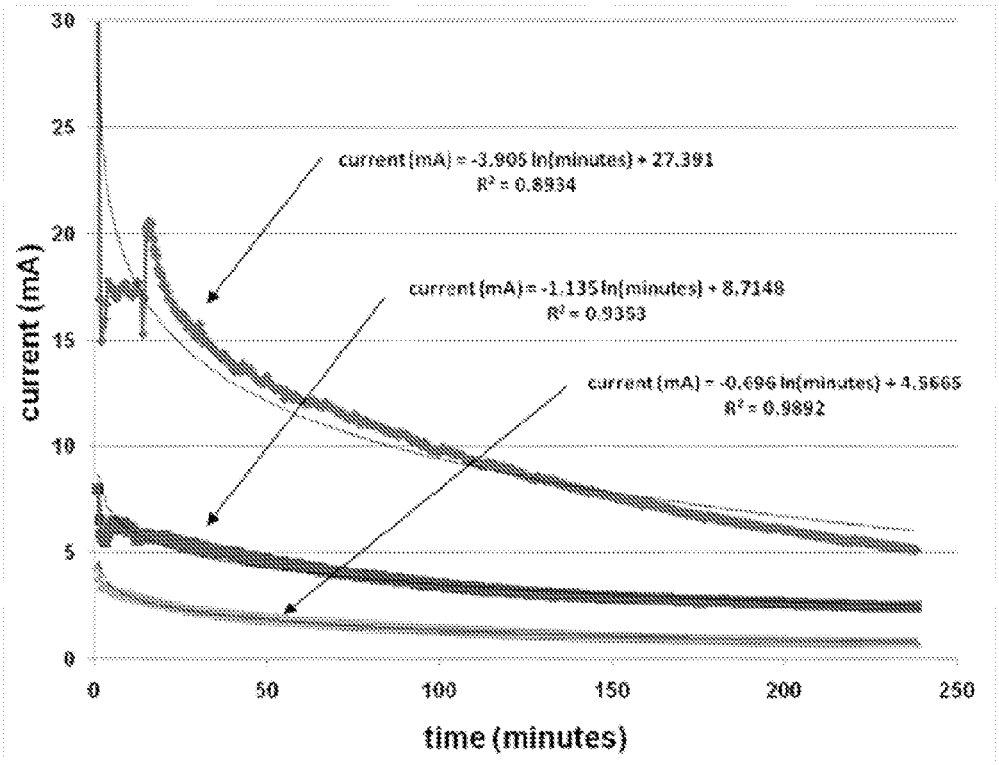
FIG. 29 is a graph depicting typical etching current (mA) vs. time (minutes) for nanotube formation in Ti6Al4V at: 60 VDC (top-most curve); 40 VDC (middle curve); and 20 VDC (bottom-most curve). Mathematical curve fitting shows good correlation with a natural logarithmic behavior. Because nanotube morphology is also correlated with etching time, etching current can be used as a feedback parameter in an automated production system.

In additional and further embodiments, the etching current of each electrode vs time is used to produce the desired surface (FIG. 29). As the nanotubes form, the metal surface becomes more porous as material is removed. Without being bound to a particular theory, this results in a progressively higher surface electrical resistance which, for each individually addressable voltage, results in a decreasing etching current. The feedback signal can be used to individually halt etching for each electrode and/or to change the voltage and/or distance of each electrode based on the rate of change of the etching current. The fully implemented automated system may have many individual electrodes (e.g., an array of electrodes), not all of which are used for a specific implant. Additionally, a system may have multiple implementations of the schematic to simultaneously process multiple implants of the same or different geometries.

Thus, a prescribed surface nanomorphology can be achieved by actively locating multiple point or cylindrical electrodes at prescribed distances, voltages, and times at different locations on the surface of the implant. Additionally, by using multiple graphite electrodes, and by selecting the voltage of each electrode and the titanium, nanotube fabrication can be allowed in selected regions of the titanium and inhibited in other selected regions of the titanium. These results can be further extended to include varying both voltage and time of each of the multiple electrodes (e.g., an array of electrodes) to fabricate nanotubular structures of selected varying lengths.

Example 4

Osteoblast Growth and Environment on Nanotube Surfaces

In vitro experiments were conducted to investigate cell density of MC3T3-E1 mouse osteoblasts (CRL-2593, subclone 4, ATCC USA). An aliquot of cells (1 ml) was mixed with alpha minimum essential medium (a-MEM, 10 ml; Invitrogen, USA) with 10 vol. % fetal bovine serum (FBS; Invitrogen, USA) and 1 vol. % penicillin-streptomycin (PS; Invitrogen, USA). The cell suspension was placed in a cell culture dish and incubated at 37° C. and 5 vol. % $CO_2$ environment. The concentration of the MC3T3-E1 osteoblastic cells was checked under an optical microscope every 24 hrs until it reached its saturation point of approximately 3000 cells/mm$^2$ after 72 hrs of incubation. When the cells reached their confluent point they were ready to be subcultured on $TiO_2$ nanotube substrates or bare control substrates. The MC3T3-E1 cells were seeded onto the experimental substrate of interest and were placed on a 30-well polystyrene plate and stored in a 37° C. $CO_2$ incubator for 24, 48 and 72 hrs to observe the cell morphology and count the number of cells attached as a function of incubation time. Samples of commercially pure Ti (cp Grade 2) and Ti6Al4V (Grade 5), with and without nanotubes were used to investigate the effect of nanotubes on adhesion, and cell density of osteoblasts. These two types of samples were chose based on the strong establishment of Ti implants in orthopedics and their preferred mechanical and biological properties.

A field-emission SEM was used for the morphological characterization of the substrates. The length of the nanotubes was determined from cross-section images. EDS chemical composition data were collected to investigate the composition of individual nanotubes and to confirm alloy nanotube composition characteristics of Ti, Al, and V. Further morphological and structural characterization of the $TiO_2$ nanostructures were carried out with a TEM operated at 200 keV. After evaluating the cell density and adhesion on $TiO_2$ nanotubes, cell counts were conducted. By rapid rinsing with a phosphate buffered saline (PBS) solution and fixation of the cells (described below) and immediate SEM imaging of the substrate, only the attached cells were counted toward the cell density. The high-resolution imaging gave the capability of distinguishing between non-flat and well-spread flat cells and the rinsing followed by rapid fixation removed the non-adherent cells, resulting in a more accurate cell count assay. The number of cells in an SEM image was counted by software. Five random fields were counted per substrate and all experiments were run in triplicate, repeated at least three times. The cell count variability was ±5 cells/mm$^2$. The mean numbers of total attached cells were calculated from the total cell number counted from 5 random square areas (1.0×1.0 mm$^2$) of each 18 different substrates. The mean numbers of attached cells on the surfaces of the control and nanotube covered samples were compared for 24, 48 and 72 hrs of incubation.

For the FIB and SEM investigations, the cells were fixed on the nanotube substrates. After 72 hrs of culture the medium was replaced with 10 ml of 90% ethanol and after 10 min the ethanol was pipetted out and the substrates were left to air dry at 37° C. for 15 min. Substrates with fixed cells were inserted into the specimen chamber of a FIB (Hitachi SA-2000). The rough milling conditions to open a trench in the cell, used ion currents of 5 to 7 nA at 30 kV. Lower beam currents of 100 to 670 pA were used to polish the cross section. Beam dwell time for milling was 3 μs.

Figure 17:
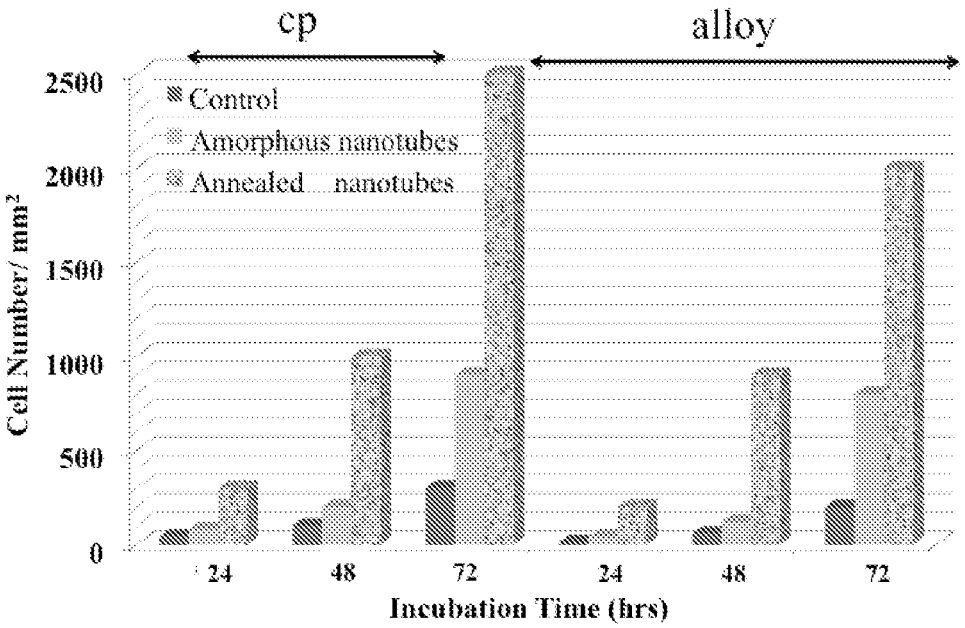
FIG. 17 is a graph showing density of adhered MC3T3 cells as a function of incubation time on the surface of commercially pure (cp) Ti (left) and alloy Ti (right) with different structures. The data confirms the effect of anodization and annealing in enhancing cell density in comparison to control bare surfaces for both cp and alloyed substrates. In the cell density of annealed substrates there was a slight increase in the case of cp nanotubes compared to alloyed nanotubes which was due to slightly higher biocompatibility of cp Ti.

The density of MC3T3 cells after up to 72 hrs of incubation on $TiO_2$ nanotubes with varying crystallinity and anodization duration was measured. The density of adhered cells on amorphous and crystalline $TiO_2$ nanotube surfaces was compared with control bare surfaces for both cp and alloy substrates (FIG. 17). On the bare control cp-Ti substrate, cell density increased from 40 cells/mm$^2$ after 24 hrs to 300 cells/mm$^2$ after 72 hrs of incubation. The presence of nanotubes enhanced cell density from 80 cells/mm$^2$ after 24 hrs to 900 cells/mm$^2$ after 72 hrs of incubation. In the case of annealed cp-$TiO_2$ nanotubes the cell density increased from 300 cells/mm$^2$ after 24 hrs to 2500 cells/mm$^2$ after 72 hrs of incubation. These results show that annealed nanotubes enhanced cell density from 900 cells/mm$^2$ in amorphous (ω-anodized) nanotubes to 2500 cells/mm$^2$ in annealed nanotubes after 72 hrs of incubation. In addition, on the bare control Ti6Al4V substrate cell density increased from 12 cells/mm$^2$ after 24 hrs to 200 cells/mm$^2$ after 72 hrs of incubation. However, the results indicate that nanotube morphology enhanced cell density from 40 cells/mm$^2$ after 24 hrs to 800 cells/mm$^2$ after 72 hrs of incubation. This enhanced cell density is in agreement with the results on cp-Ti and cp-$TiO_2$ nanotubes.

Figure 18:
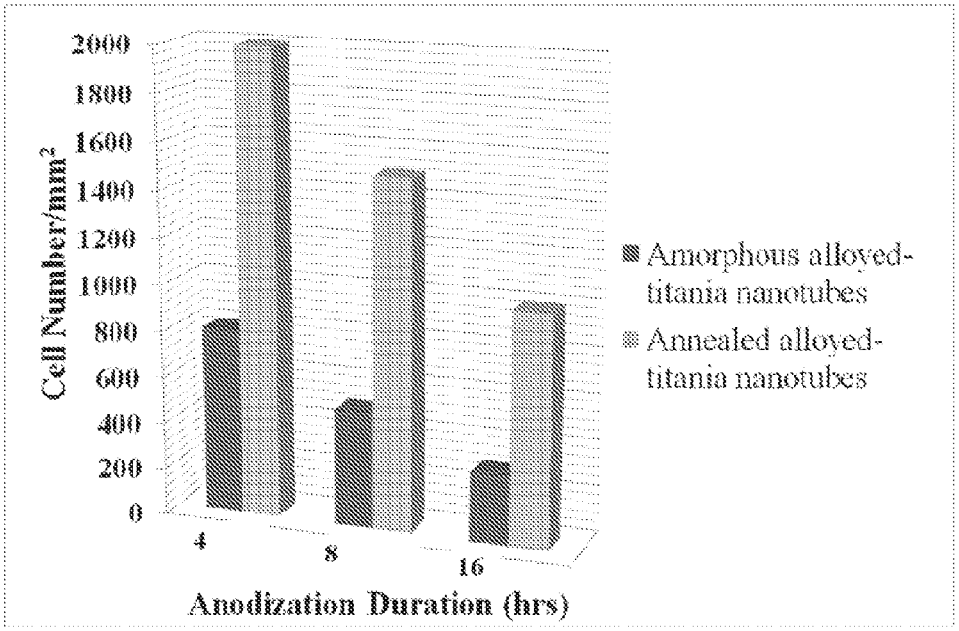
FIG. 18 is a graph depicting the effect of nanotube length, crystallinity, and composition on cell number and attachment.

However, the total cell density in the control Ti6Al4V and alloyed-$TiO_2$ nanotubes was slightly lower for all incubation periods, in comparison to the total cell density in cp-Ti and cp-$TiO_2$ nanotubes. Without being bound to a particular theory, this may be due to slightly lower biocompatibility of the alloying elements (Aluminium and Vanadium) and their oxides. Also, longer anodization duration resulted in longer and more flexible nanotubes. Without being bound to a particular theory, the surface of bare control samples showed the lowest cell density, because the surface of bare control samples has a very high mechanical stiffness (essentially the elastic modulus of Ti). As the length of the nanotubes increased beyond the length defined by an etching time of 4 hours, the cell density decreased (FIG. 18). This result indicates that there is an optimal nanotube length associated with optimal bending stiffness.

FIB Milling Studies at Cell-Nanotube Interfaces

Focused ion beam (FIB) milling studies at cell-nanotube interfaces provided evidence of the cell filopodia growth inside the nanotubes, demonstrating a strong interlock between the cell and substrate.

Initially, fibroblast adhesion to $TiO_2$ nanotubes was examined by the FIB method and then this assay was extended to osteoblast cells. The main reason to select fibroblasts for the initial FIB work was that these cells make strong bonds with most substrate materials. In addition, fibroblast cells are the first to bond with the surface of the implant in in-vivo application of biomedical implants.

Figure 19:
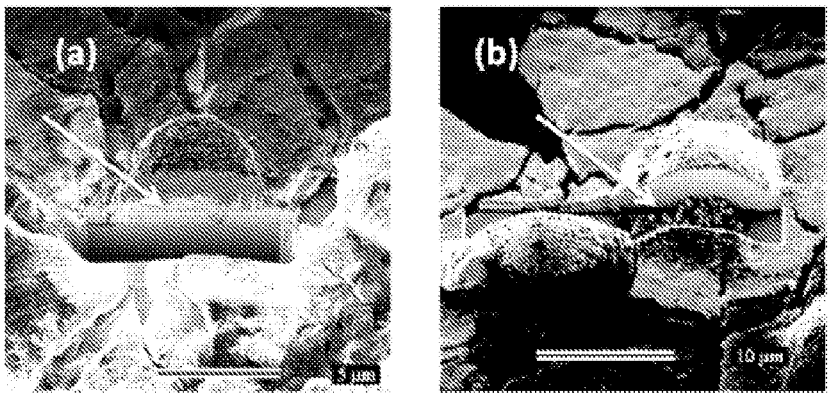
FIGS. 19A and 19B are images of FIB milled fibroblast cells obtained from a primary ion beam. Internal structures, membranes and morphological stability and integrity can be assessed; moreover, the interface between the cell and the substrate can be observed. Scale bars are 5 μm (FIG. 19A), and 10 μm (FIG. 19B).
Figure 20:
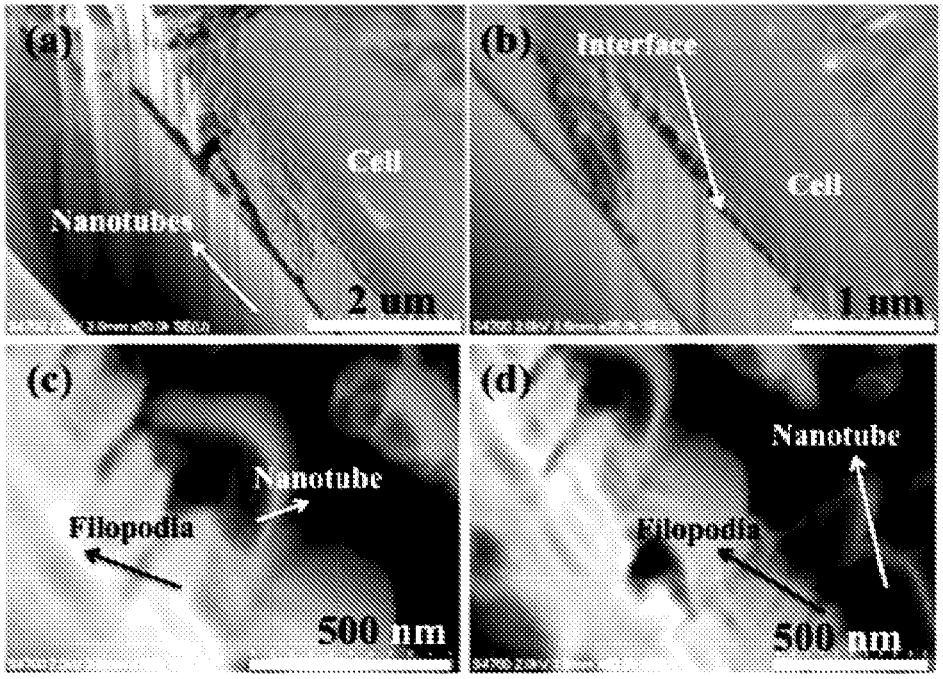
FIGS. 20A-20D show SEM images of a cross-sectional view of the cell-nanotube interface (FIGS. 20A and 20B), milled by the FIB technique and a magnified view of cell-nanotube interaction and filopodia growth inside a nanotube (FIGS. 20C and 20D). Scale bars are 2 μm (FIG. 20A), 1 μm (FIG. 20B), and 500 nm (FIGS. 20C and 20D).

FIB milled fibroblast cells were obtained from a primary ion beam (FIGS. 19A and 19B). The results show that fibroblast filopodia strongly interacted with the cell's nano-environment. Internal structures, membranes and morphological stability and integrity are shown by the FIB method. The interface between the cell and the substrate was observed in the magnified cross sectional view of the cell-nanotube interface (FIGS. 20A-20D). After milling the cell by FIB, the filopodia appeared to grow into the nanotubes. The results also revealed that fibroblast sustained very high vacuum without visible damage and they physically survived ion beam milling and imaging. Moreover, ion milling revealed many internal features of cells at the submicron scale as well as the high interaction and growth of the cells among the nanotubes.

Figure 21:
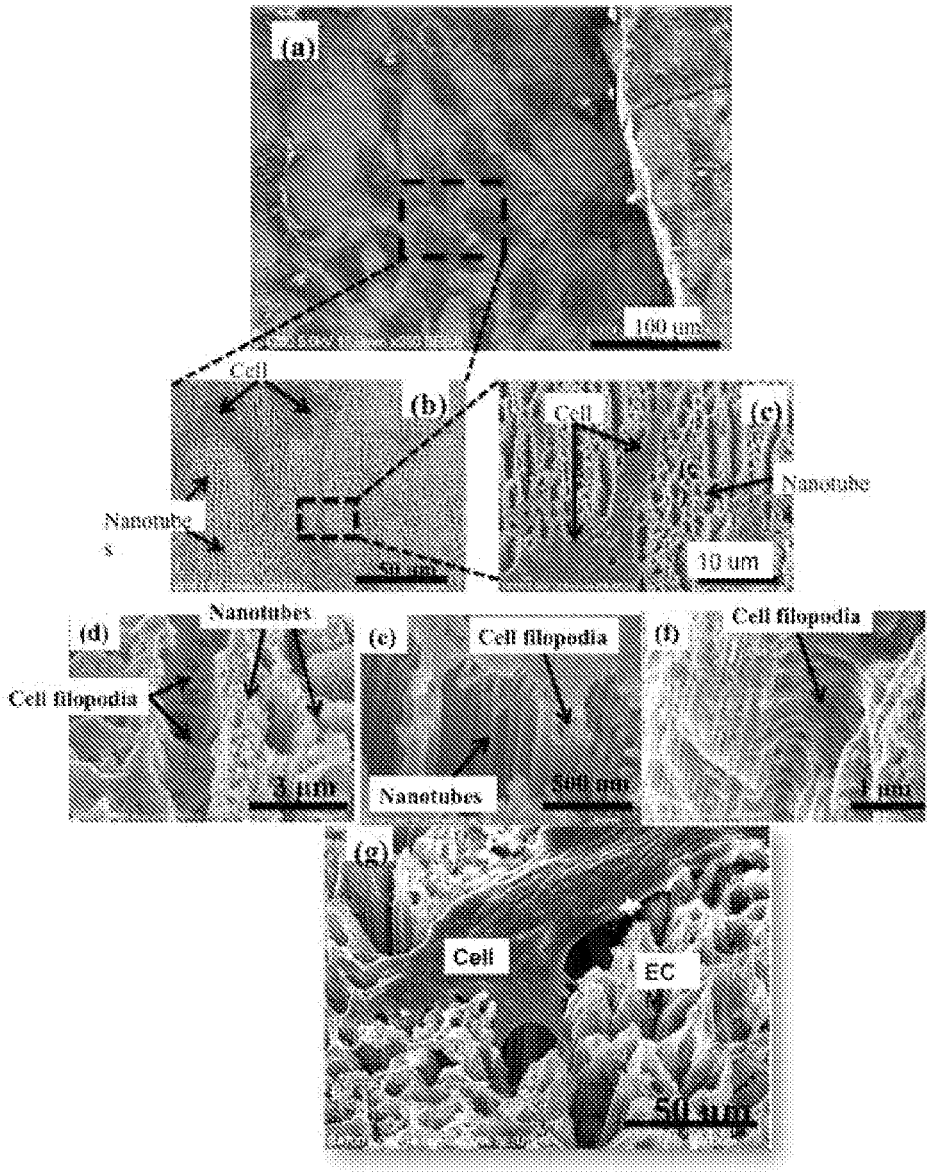
FIGS. 21A-21G are images showing osteoblast cell interaction with $TiO_2$ nanotubes. The extension of osteoblast cells for adhesion on the nanotubes as well as cell clusters on the nanotube surface (FIGS. 21A-21C) indicate the ability of the nanotube structure to promote cell adhesion and growth. Scale bars are 100 μm (FIG. 21A), 50 μm (FIG. 21B), and 10 μm (FIG. 21C).
Figure 22:
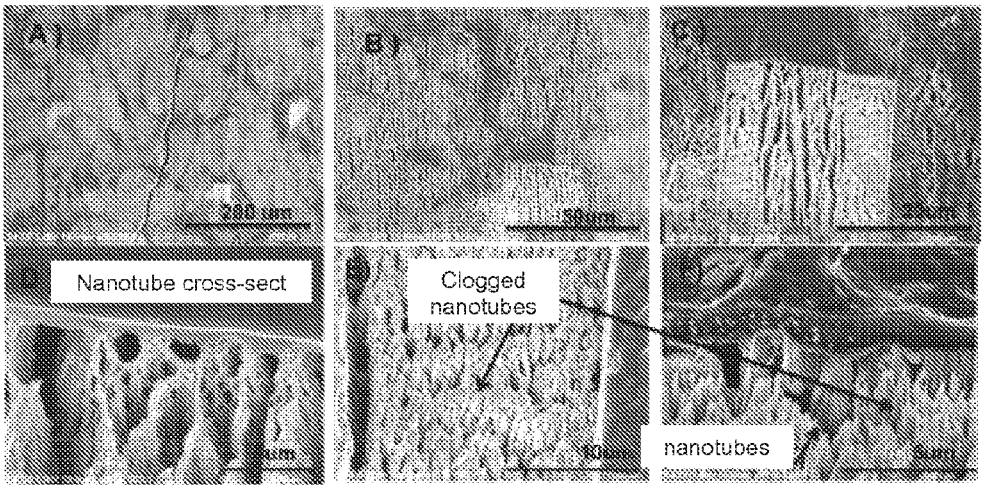
FIG. 22A-22F are images of FIB cross sectional milling revealing titania nanotubes which have been clogged by osteoblast and calcium deposition on nanotubes as a result of cell attachment and direct contact with surface. Scale bars are 200 μm (FIG. 22A), 50 μm (FIG. 22B), 20 μm (FIG. 22C), 5 μm (FIGS. 22D and 22F), and 10 μm (FIG. 22E).

The same FIB and SEM method was adapted to evaluate osteoblast cell attachment and surface interaction. The interaction of MC3T3 osteoblast cells with $TiO_2$ nanotubes was analyzed by SEM (FIGS. 21B and 21C). The extension of osteoblast cells for adhesion on the nanotubes, as well as cell clusters (FIG. 21A) on the nanotube substrates, indicated the ability of the nanotube structure to promote cell adhesion and growth. As observed in the SEM images, the surface tended to induce cell number, attachment, and spreading. The osteoblast cells had a fully spread morphology (FIG. 21A) as well as expansion of cell filopodia (FIGS. 21B and 21C). Attachment of cell filopodia to the nanotubes and filopodia expansion between the nanotubes was also observed. Thus, the nanotubes acted as anchors for cell filopodia to grab (FIGS. 21F and 21G), increase spreading (FIG. 21D), and improve attachment (FIG. 21G).

Figure 23:
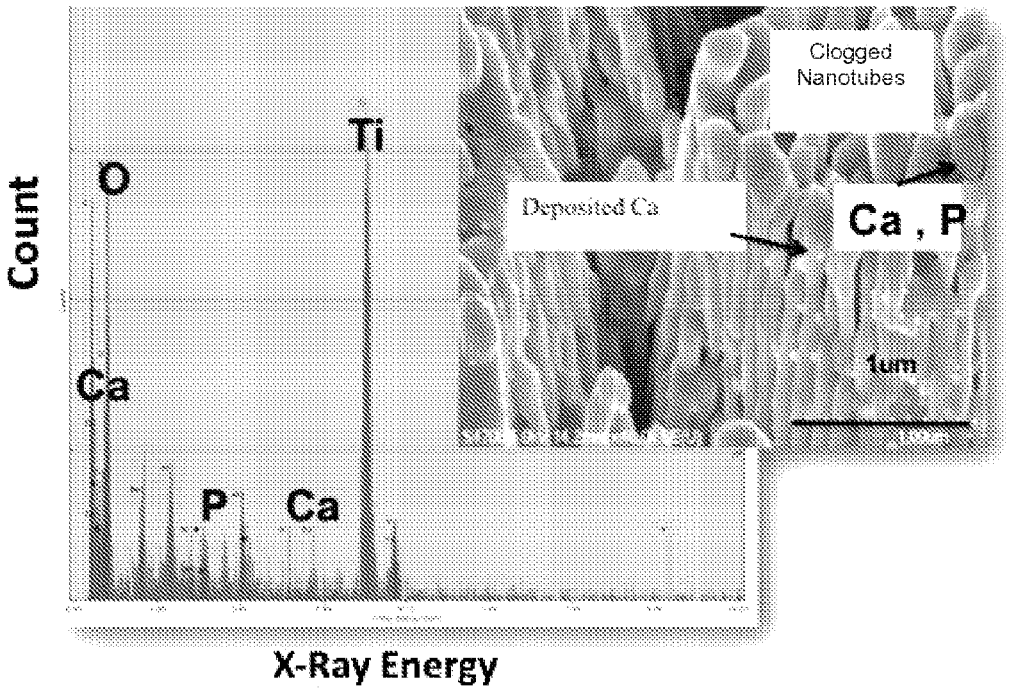
FIG. 23 depicts EDS analysis of clogged nanotubes as shown in a high-resolution scanning electron micrograph (inset). The clogged nanotubes were visible and composed of Ca and P (by EDS), the primary components of bone matrix. Scale bar is 1 μm.

The evaluations of cell anchorage and interlock were performed by FIB milling and SEM. The architecture of the cell/substrate interface was visualized by SEM (ion beam imaging resolution is lower) to provide better insight into the morphological and functional features of interfacial osteoblast cell attachment. SEM images of the FIB milled cells revealed that the nanotubes were completely clogged by the cells (FIGS. 22A-22D). Even after removal of the cell top section by FIB (FIGS. 22C and 22D) the nanotubes remain clogged (FIGS. 22E and 13F) approximately 5 nm in depth (FIG. 14). Clogging is due to high attachment of the cells (qualitatively indicated from SEM images in FIGS. 21A-21G and 22A-22E), indicating the well spread cell morphology and the cell growth inside the hollow section of the nanotubes (FIG. 23). The osteoblasts were in direct cell/substrate contact with the nanotubes and were firmly attached to the substrate surface (FIGS. 22A-22E). EDS chemical analysis showed that the bond between the nanotubes and the adjacent osteoblast cell layer is composed of calcium and phosphorous elements which therefore seemed to mimic the bond in the bone tissue itself. On the substrate surface, cell filopodia and the extracellular matrix remained attached following separation from the milled top section of the cell (FIGS. 22A-22E and 23). These observations revealed a close interfacial contact or direct contact between the osteoblasts and the nanotubes followed by calcium and phosphorous deposition on the nanotubes (FIG. 16). Calcium and phosphorous are the primary components of bone matrix. The deposition of calcium and phosphorous onto nanotubes was confirmed, indicating that nanotubes maintained osteoblast functionality (FIG. 23).

The SEM images (FIG. 21G) and EDS analysis (FIG. 23) showed that extracellular matrix (ECM) was secreted over the surface of the sample and deposition of calcium and phosphorous on the nanotubes, respectively. The cellular activity of osteoblasts on the surface initiates with deposition of calcium and phosphorous as primary components of bone matrix. This production of ECM on the nanotubes was observed to be the result of osteoblast migration and health cellular activity. Without being bound to a particular theory, the nanotubes act as anchors for the cell filopodia to grab onto and facilitate cell migration along the surface. The anchorage benefit of nanotubes together with their strong hydrophilic properties contributed to increased osteoblast density, spreading and attachment and achieved high-cohesion osseointegration.

The osteoblast cell culture experiments on the substrates without nanotubes and substrates with nanotubes indicated the presence of nanotube morphology increased cell density. The nanotubes act as anchors for the cell filopodia to grab onto and have facilitated migration along the surface. The deposition of calcium and phosphorous which are the primary components of bone matrix onto nanotubes indicates that nanotubes have maintained osteoblast functionality. In view of nanotube structure, the crystalline anatase nanotubes were more effective in enhancing the cell growth in comparison to the amorphous nanotubes probably due to increased hydrophilicity. From a geometrical perspective, the nanotubes with the same crystalline structure and chemical composition, but lower anodization duration and consequently smaller length and diameter, showed higher cell density. The total cell density in the bare control cp-Ti (Grade 2) and cp-$TiO_2$ nanotubes is slightly higher for all incubation periods, in comparison to the total cell density in bare control Ti alloy (Grade 5) and alloyed $TiO_2$ nanotubes. This behavior may be explained by slightly lower biocompatibility of the alloying elements (Al and V) and their oxides. EDS chemical analysis suggested that the bond between the nanotube substrate and the adjacent osteoblast cell layer is composed of calcium and phosphorous elements which therefore seemed to mimic the bond in the bone tissue itself. Based on FIB results, on the nanotube covered surfaces, cells were observed to extend protrusions in both the lateral and vertical directions, growing not only on top of the nanotubes but also between and potentially down into the open nanotube pores. This anchorage benefit of nanotubes together with their strong hydrophilic properties appears to have increased osteoblast density, spreading and attachment for a promising high-cohesion osseointegration.

Example 5

Nanotube Fabrication on Orthopedic Bone Screws

To demonstrate the applicability of these processes in the orthopedic industry and to show the structural robustness, nanotubes were fabricated on Ti6Al4V ELI orthopedic bone screws. These specimens were outdated surplus cancellous screws 6.5 mm OD and 3.2 mm ID (Linvatec of Largo, Fla.).

Figure 24A:
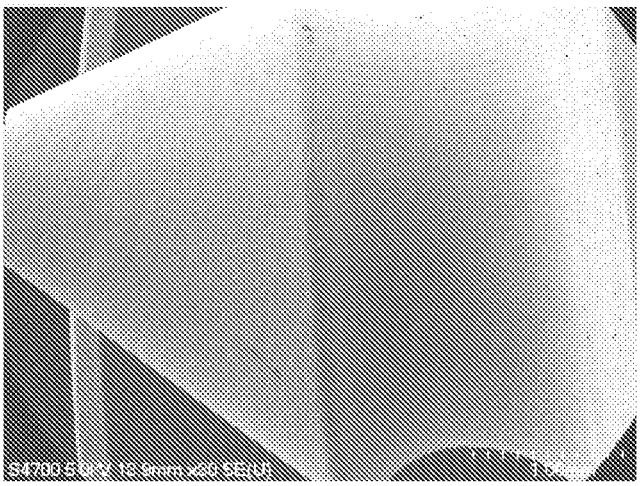
FIGS. 24A and 24B are scanning electron micrograph images of nanotube-covered Ti6Al4V ELI cancellous bone screws. Scale bars are 1 mm (FIG. 24A) and 1 μm (FIG. 24B).
Figure 24B:
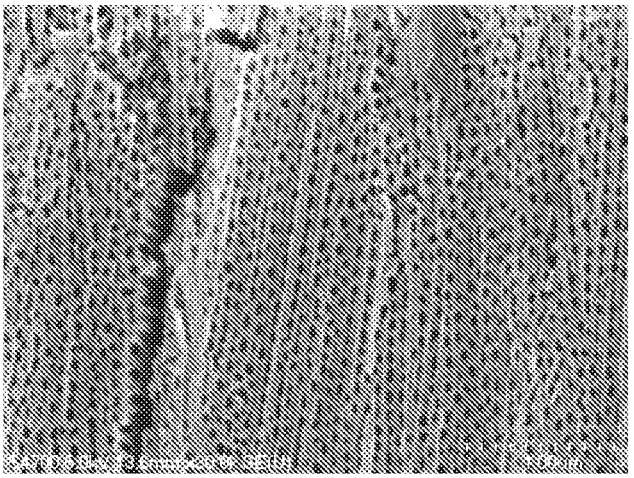

Nanotubes were fabricated on the cancellous bone screws using the standard setup with the screw connected to the positive terminal and a graphite rod connected to electrical ground. An approximate 12 mm portion of the end of the bone screw was immersed into the electrolyte and the circuit was energized at +60 VDC. After 15 minutes, the screw was further immersed into the electrolyte an additional approximately 12 mm for an additional 15 minutes of etching time. In this manner, the end portion of the screw had "30 minute nanotubes" and the middle portion of the screw had "15 minute nanotubes." The separation distance between the screw and graphite rod was approximately 100 mm. Nanotubes were observed to be fabricated over all regions of the bone screws (FIGS. 24A and 24B).

Torque Insertion and Removal in Bone Simulant

To demonstrate the robustness of the nanotubes and to compare with predicted results from structural computer models, the nanotube covered bone screws were subjected to super-physiological forces that may be encountered during surgical implantation. Bone screws were selected because they experience shear and surface-normal forces during insertion into bone that are greater than during normal patient use. Additionally, screw loosening is an implant failure mechanism whereby increased bone adhesion can provide a solution.

Bone stimulant material (Sawbones 1522-03, 20 pounds per cubic foot polyurethane) had multiple pilot holes drilled into it with recommended diameters obtained from the literature for different conditions of bone. The pilot-hole diameters were 3.2 mm, 4.5 mm, 4.9 mm, and 5.0 mm. The bone screws have a thread root diameter of 3.2 mm and an outside thread diameter of 6.5 mm. Therefore when screwed into the 3.2 mm diameter pilot holes, the screw threads have full radial engagement with the bone stimulant. When the screws are inserted into larger diameter pilot holes, there is less radial thread engagement.

The screws were progressively inserted into the bone stimulant while measuring the required insertion torque. These measurements were accomplished by placing a force scale at the end of a hex wrench of the appropriate size for the bone screws. The maximum force required to turn the screws at various depths of engagement were recorded. Each force was multiplied by the perpendicular distance from the axis of the screw to the line of action of the force scale to obtain the insertion torque.

Torque measurements were made over 3 insertion depth regions of the screws. These regions were the '$1^{st}$ third" with 2-3 complete threads engaged into the bone stimulant measured from the screw tip, and subsequently the "$2^{nd}$ third' with 4-6 total threads engaged, and the $3^{rd}$ third" with 7-9 total threads engaged. The screws used (45 mm total length) had a total of approximately 11 complete threads. Each torque data point was calculated from 12 measurements for each "insertion third".

Figure 25:
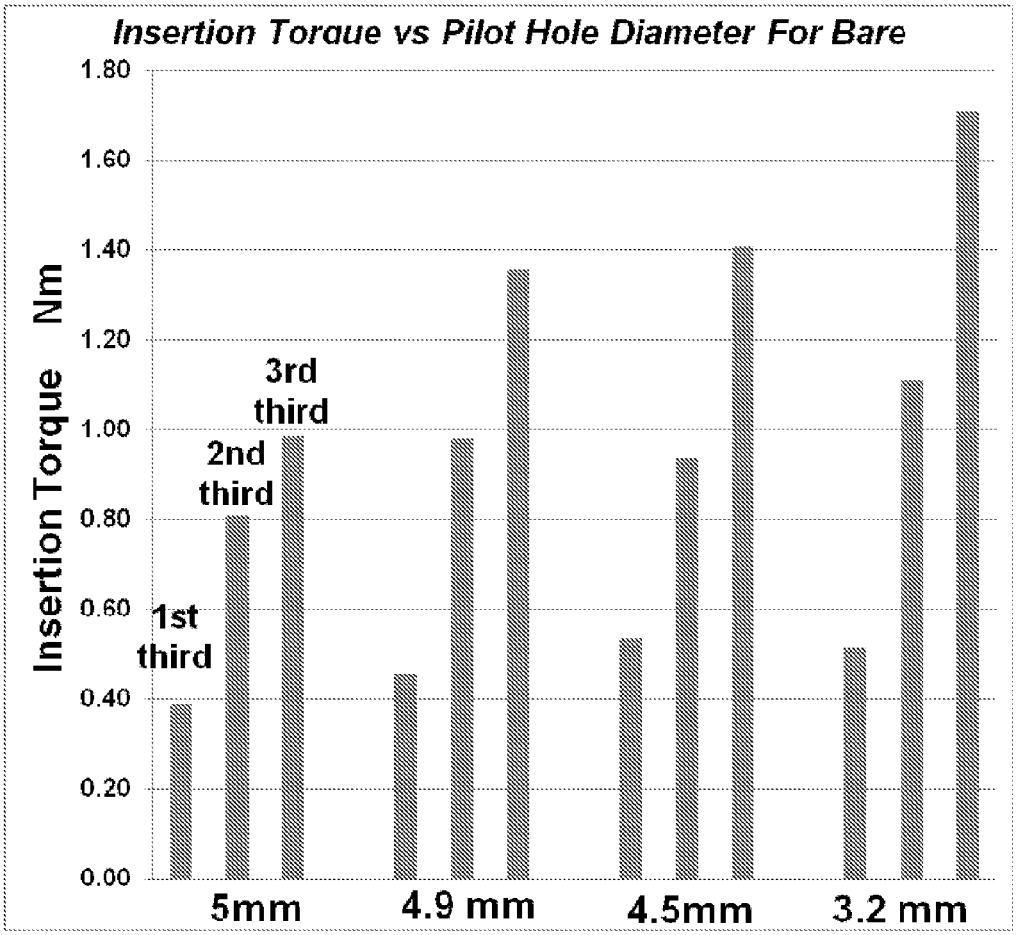
FIG. 25 is a graph showing the comparison of insertion torque and pilot-hole diameter for a bare Ti6Al4V ELI cancellous bone screw.
Figure 26:
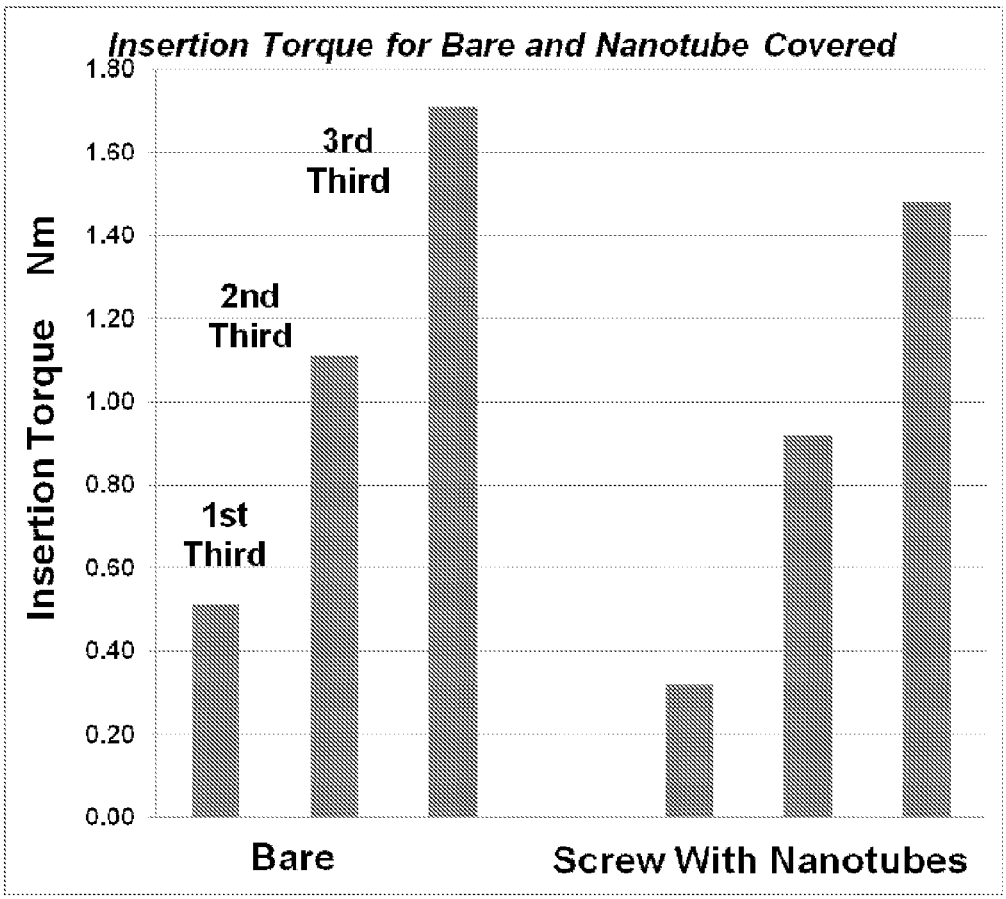
FIG. 26 is a graph showing a comparison of insertion torque for a bare Ti6Al4V ELI cancellous bone screw and a nanotube-covered Ti6Al4V ELI cancellous bone screw.

Insertion torque measurements were graphed and a bare screw was used as a control for comparison (FIG. 25). Insertion torque was compared between the bare control screw and a nanotube-covered screw with a 3.2 mm diameter pilot hole with full radial thread engagement (FIG. 26). The nanotube-covered screws exhibited a lower insertion torque requirement, perhaps because of the lower mechanical stiffness of the surface. Without being bound to a particular theory, it has been hypothesized that this lower mechanical stiffness is partially responsible for increased cell growth and adhesion.

Nanotube Survivability

Figure 27:
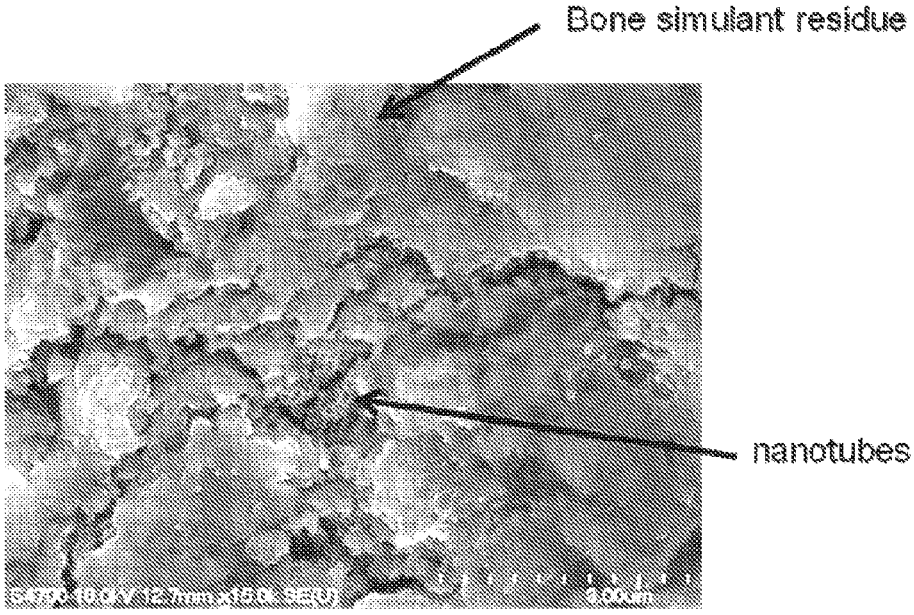
FIG. 27 is an SEM image of a nanotube-covered bone screw after insertion and removal in a 5 mm pilot hole in bone stimulant and subsequent insertion and removal in a 3.2 mm pilot hole in bone stimulant.
Figure 28:
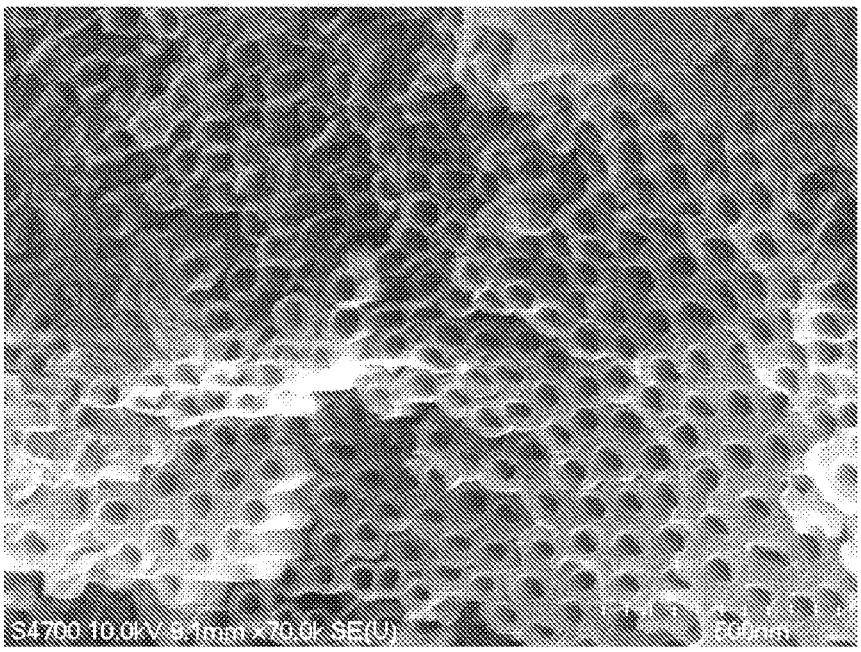
FIG. 28 is an SEM image of a nanotube-covered bone screw after insertion and removal in a 5 mm pilot hole in bone stimulant and subsequent insertion and removal in 3.2 mm pilot hole in bone stimulant, and after cleaning by vaporization of bone stimulant and sonication cleaning.

Bone screws were inserted into and removed from bone stimulant with a 5.0 mm diameter pilot hole and then inserted into and removed from bone stimulant with a 3.2 mm diameter hole. After undergoing these procedures, the bone screws were inspected in the SEM. Deposition of polyurethane on top of the bone screw was observed as a result of tapping the threaded hole in the bone stimulant. The polyurethane layer had openings through which intact nanotubes were observed (FIG. 27). To remove this contamination layer, the nanotube covered screws were heated at 350° C. for 30 minutes to vaporize the polyurethane. The screw was then sonicated in water to remove any remaining debris. After this aggressive treatment, the screw was re-examined in the SEM confirming that the nanotubes had remained intact (FIG. 28).

Thus, using graphite electrodes, nanotubular structures were fabricated into Ti6Al4V ELI surgical orthopedic cancellous and cortical bone screws. The nanotubes on the bone screws survived multiple insertion and removal cycles in an accepted bone stimulant material.

Example 6

Deposition of Silver on $TiO_2$ Nanotube Surfaces

Nanotubes were fabricated onto and/or into the surface of Ti6Al4V titanium alloy by anodization using an AgF electrolyte. $TiO_2$ nanotube surfaces made in this manner were studied for the purpose of depositing silver on titanium surfaces.

The fabrication process used an etching system involving a Ti anode, a counter electrode, an electrolyte, and a DC power source. The substrates for nanotube etching were flat, 2 cm×3 cm area and 0.25 mm thickness, and polished with 0.06 mm colloidal $SiO_2$. Prior to nanotube etching, the substrates were sequentially sonicated in acetone, isopropyl alcohol, and methanol, then rinsed with deionized water and dried in an $N_2$ stream. The experimental setup consisted of a two-electrode arrangement. Graphite was used as the counter electrode for the anodizations. The spacing between the substrates and the counter electrode was approximately 25 mm. Etching conditions were 60 VDC and a time of 30 minutes. The anodization was carried out at room temperature. The electrolyte was a solution of AgF in 49 ml ethylene glycol and 1 ml deionized water (49 mL ethylene glycol, 1 mL water, and 0.9 grams of silver fluoride). The innocuous etching electrolyte (AgF and ethylene glycol rather than HF) makes the process considerably safer, cheaper, and easier to maintain by eliminating the need for costly specialized environmental containment and disposal safeguards. Additionally, it ensures that any residual chemical etchant that might cling to the product surface would be essentially benign. A constant 60 V DC was used for all experiments. After anodization, the samples were rinsed with deionized water and dried in a $N_2$ stream.

Figure 30A:
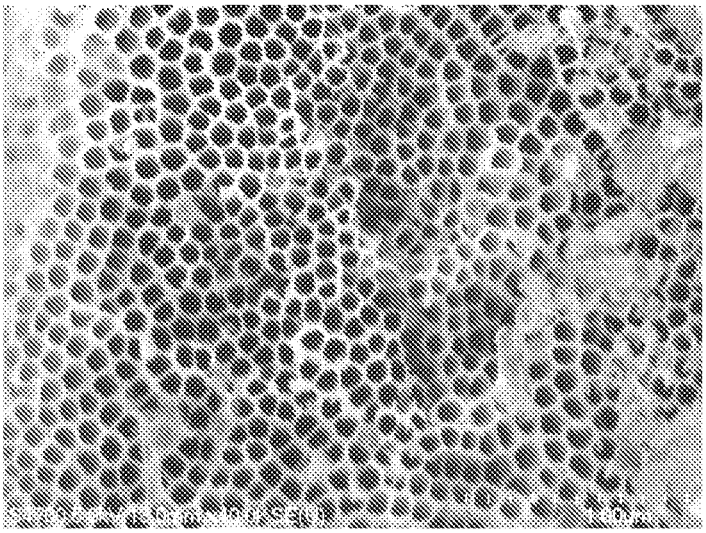
FIGS. 30A and 30B are scanning electron micrograph images of nanotubes on titanium alloy Ti6Al4V fabricated with AgF-containing electrolyte. Etching conditions were 60 VDC and time of 30 minutes. Nanotube length was approximately 2 microns. Only trace levels of silver were found when conducting elemental analysis. Scale bars are 1 μm (FIG. 1A), and 500 nm (FIG. 1B).
Figure 30B:
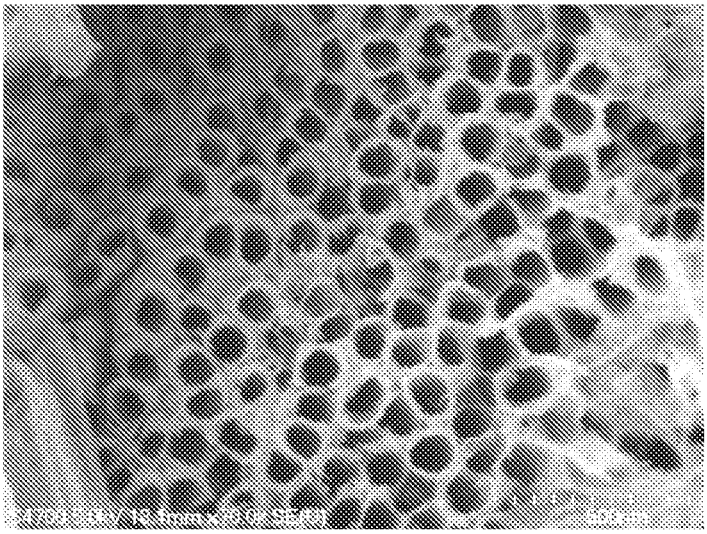

Nanotubes were fabricated on titanium alloy Ti6Al4V with the AgF-containing electrolyte (FIGS. 30A and 30B). The nanotubes were approximately 2 microns in length.

Figure 31:
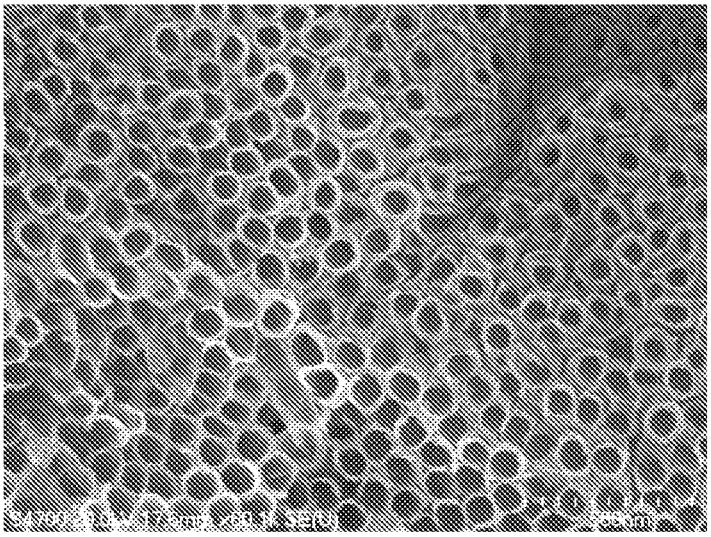
FIG. 31 is a scanning electron micrograph image of nanotubes on titanium alloy Ti6Al4V fabricated with AgF-containing electrolyte. Etching conditions were 60 VDC and time of 30 minutes. Electrode polarity was immediately reversed and silver deposition time was 15 minutes.

The $TiO_2$ nanotube fabrication process was modified so that after anodization (etching conditions: 60 VDC; 30 minutes), electrode polarity was immediately reversed. Again, nanotubes on titanium alloy Ti6Al4V were fabricated with AgF-containing electrolyte (FIG. 31). When the $TiO_2$ nanotube fabrication process included reversing the electrode polarity for 15 minutes after anodization, silver was deposited on the titanium substrate surface. X-ray elemental analysis indicated that silver was deposited over the titanium substrate surface, and that silver was the second most abundant element after titanium. The titanium alloy is 6% by weight aluminum and 4% by weight vanadium, and the silver content appeared to be greater than either of these two alloy constituents. Thus, $TiO_2$ nanotube surfaces comprising silver were generated.

Example 7

Varying the Relative Presence of Silver in Nanotubes

The presence of silver in or on the nanotube surface can confer anti-bacterial properties of the surface. However, the amount of silver in or on the surface will impact those anti-bacterial properties. For example, too low of a silver content has no adverse effect on bacteria whereas an overabundance of silver, while it can act as an anti-bacterial agent, can damage normal tissue cells. The type of bacteria that are targeted and the bacteria's resiliency will dictate an acceptable range of silver presence. It is therefore important to be able to adjust the silver presence during the single process step of creating silver-bearing titanium nanotubes.

Experiments were conducted to demonstrate this capability according to embodiments of the invention. As discussed above, a nanotube-etching electrolyte is prepared by dissolving a given amount of silver fluoride in 2 mL of deionized water and 98 mL of ethylene glycol to produce a total of 100 mL of etching electrolyte. In this Example, the mass of silver fluoride added to electrolyte was varied over a wide range, namely 0.1 grams, 1.1 grams, and 2.25 grams per 100 mL of electrolyte. Nanotubes were formed using 60 volts DC for a total duration of 20 minutes. The relative presence of silver, on both an atomic percent presence and a weight percent presence was measured by energy-dispersive X-ray spectroscopy. The results are shown in FIG. 32.

Figure 32:
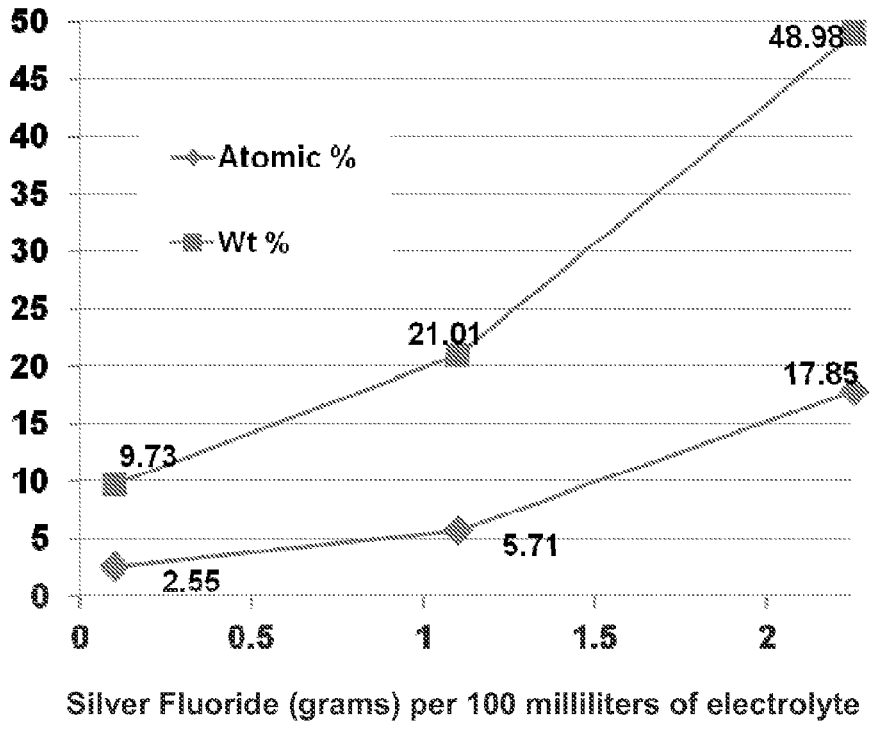
FIG. 32 shows the relative presence of silver associated with a nanotube surface, on both an atomic percent presence and a weight percent presence as measured by energy-dispersive X-ray spectroscopy.

As shown in FIG. 32, as the mass of silver fluoride present in the same volume of electrolyte increases, the presence of silver in the nanotube-covered sample surface rapidly increases, such as a seven-fold increase in the percent presence of silver atoms (diamonds, lower trace) and a five-fold increase in the weight of silver present (squares, upper trace).

The results disclosed herein demonstrate the capability to control the presence of silver which ends up in nanotubes following etching, which can in turn be used to affect a particular or several bacteria when lethal silver levels are known for those bacteria. In various embodiments, the amount of silver that is present during etching, which influences the amount of silver that is associated with the modified surface, may be varied in a range from 0.001 to 4 grams per 100 mL of electrolyte solution, including amounts of 0.01 grams, 0.5 grams, 1.0 grams, 1.5 grams, 2.0 grams, 3.0 grams, and 3.5 grams per 100 mL.

In other embodiments, the relative amount of silver in the final nanotube surface can be varied by varying the etching parameters that control the size of the nanotubes. Larger and longer nanotubes with more surface area will contain more silver. These etching variables include: (1) etch time, a longer etch time results in longer nanotubes and more open volume among the nanotubes (as previously shown) providing more surface onto/into which silver will be incorporated; and (2) etch voltage, a higher etching voltage results in longer nanotubes and more open volume among the nanotubes (as previously shown) providing more surface onto or into which silver will be incorporated.

Other Embodiments

From the foregoing description, it will be apparent that variations and modifications may be made to the invention described herein to adopt it to various usages and conditions. Such embodiments are also within the scope of the following claims.

The recitation of a listing of elements in any definition of a variable herein includes definitions of that variable as any single element or combination (or subcombination) of listed elements. The recitation of an embodiment herein includes that embodiment as any single embodiment or in combination with any other embodiments or portions thereof.

All patents and publications mentioned in this specification are herein incorporated by reference to the same extent as if each independent patent and publication was specifically and individually indicated to be incorporated by reference.

What is claimed is:

1. A method for modifying a surface by generating nanotubes at one or more selected sites on the surface, the surface comprising a first metal, the method comprising:

positioning at least one cathode and at least one anode relative to the surface in an electrolyte solution comprising a fluoride salt of a second metal; and applying a voltage between the at least one anode and the at least one cathode sufficient to generate nanotubes at one or more selected sites on the surface by removing a portion of the first metal from the surface by etching, and to inhibit nanotube formation at one or more of the other selected sites, wherein the nanotubes comprise the first metal and the second metal;

wherein the electrolyte solution comprises AgF or $CaF_2$.

2. The method of claim 1, further comprising applying a voltage of reverse polarity to the at least one cathode and the at least one anode sufficient to deposit the second metal onto the surface.

3. The method of claim 1, wherein the first metal comprises titanium.

4. The method of claim 3, wherein the second metal comprises silver.

5. The method of claim 4, further comprising varying a level of silver in the electrolyte solution to vary an amount of silver associated with the surface.

6. The method of claim 5, wherein varying a level of silver in the electrolyte solution comprises adjusting a level of silver in a range from 0.1 to 2.25 grams per 100 mL of electrolyte solution.

7. The method of claim 6, wherein the electrolyte solution comprises ethylene glycol and water.

8. The method of claim 1, wherein the at least one cathode and the at least one anode comprise graphite.

9. The method of claim 1, wherein the second metal reduces the propensity of the surface to support bacterial cell growth.

10. The method of claim 1, wherein the voltage is approximately 60 VDC.

11. The method of claim 1, wherein the surface comprises titanium.

12. The method of claim 1, further comprising coating the surface with at least one of an anti-bacterial agent, a growth factor, and an anti-inflammatory agent.

13. The method of claim 1, further comprising loading the nanotubes with an effective amount of a biologically active agent.

14. The method of claim 1, wherein the surface is present on a biomedical implant or medical device.

15. The method of claim 1, wherein the surface is present on a biomedical implant which is selected from the group consisting of a dental implant, a cardiovascular implant, a neurological implant, a neurovascular implant, a gastrointestinal implant, a muscular implant, an orthopedic implant, a cochlear implant, and an ocular implant.

16. The method of claim 1, wherein the surface is present on an orthopedic implant which is selected from the group consisting of joint implants, spinal implants, screws, pins, rods, and plates.

17. A method for modifying a surface by generating nanotubes at one or more selected sites on the surface, the surface comprising a first metal, the method comprising:

positioning at least one cathode and at least one anode relative to the surface in an electrolyte solution comprising a fluoride salt of a second metal; and applying a voltage between the at least one anode and the at least one cathode sufficient to generate nanotubes at one or more selected sites on the surface by removing a portion of the first metal from the surface by etching, and to inhibit nanotube formation at one or more of the other selected sites, wherein the nanotubes comprise the first metal and the second metal; and applying a voltage of reverse polarity to the at least one cathode and the at least one anode sufficient to deposit the second metal onto the surface.

18. A method for modifying a surface by generating nanotubes at one or more selected sites on the surface, the surface comprising a first metal, the method comprising:

positioning at least one cathode and at least one anode relative to the surface in an electrolyte solution comprising a fluoride salt of a second metal; and applying a voltage between the at least one anode and the at least one cathode sufficient to generate nanotubes at one or more selected sites on the surface by removing a portion of the first metal from the surface by etching, and to inhibit nanotube formation at one or more of the other selected sites, wherein the nanotubes comprise the first metal and the second metal;

wherein the first metal comprises titanium, and the second metal comprises silver.

19. The method of claim 18, further comprising varying a level of silver in the electrolyte solution to vary an amount of silver associated with the surface.

20. The method of claim 19, wherein varying a level of silver in the electrolyte solution comprises adjusting a level of silver in a range from 0.1 to 2.25 grams per 100 mL of electrolyte solution.

21. The method of claim 20, wherein the electrolyte solution comprises ethylene glycol and water.

22. A method for modifying a surface by generating nanotubes at one or more selected sites on the surface, the surface comprising a first metal, the method comprising:

positioning at least one cathode and at least one anode relative to the surface in an electrolyte solution comprising a fluoride salt of a second metal; and applying a voltage between the at least one anode and the at least one cathode sufficient to generate nanotubes at one or more selected sites on the surface by removing a portion of the first metal from the surface by etching, and to inhibit nanotube formation at one or more of the other selected sites, wherein the nanotubes comprise the first metal and the second metal;

wherein the at least one cathode and the at least one anode comprise graphite.

* * * * *